US011873542B2

(12) United States Patent
Nishida et al.

(10) Patent No.: US 11,873,542 B2
(45) Date of Patent: Jan. 16, 2024

(54) HIGH NICKEL ALLOY EXCELLENT IN HIGH WELDING TEMPERATURE CRACKING RESISTANCE

(71) Applicants: NIPPON STEEL Stainless Steel Corporation, Tokyo (JP); NIPPON STEEL CORPORATION, Tokyo (JP)

(72) Inventors: Yukihiro Nishida, Tokyo (JP); Shinji Tsuge, Tokyo (JP); Takahiro Osuki, Tokyo (JP)

(73) Assignees: NIPPON STEEL STAINLESS STEEL CORPORATION, Tokyo (JP); NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 18/036,699

(22) PCT Filed: Apr. 12, 2022

(86) PCT No.: PCT/JP2022/017594

§ 371 (c)(1),
(2) Date: May 12, 2023

(87) PCT Pub. No.: WO2022/220242

PCT Pub. Date: Oct. 20, 2022

(65) Prior Publication Data

US 2023/0349027 A1 Nov. 2, 2023

(30) Foreign Application Priority Data

Apr. 14, 2021 (JP) ..... 2021-068346
Apr. 14, 2021 (JP) ..... 2021-068601
Apr. 14, 2021 (JP) ..... 2021-068602

(51) Int. Cl.
*C22C 19/05* (2006.01)
*C22C 38/58* (2006.01)

(52) U.S. Cl.
CPC ..... *C22C 19/055* (2013.01); *C22C 38/58* (2013.01)

(58) Field of Classification Search
CPC ..... C22C 19/055; C22C 38/58
See application file for complete search history.

(56) References Cited

U.S. PATENT DOCUMENTS

2018/0216215 A1 8/2018 Hirata et al.
2019/0360079 A1* 11/2019 Yamakawa ..... C22F 1/16
2020/0347488 A1 11/2020 Mizuno et al.
2022/0259688 A1 8/2022 Osuki et al.

FOREIGN PATENT DOCUMENTS

CN 109790608 A 5/2019
JP 2003-147492 A 5/2003
JP 2004-149833 A 5/2004
JP 2005-126738 A 5/2005
JP 2014-84493 A 5/2014
JP 2014-189826 A 10/2014
JP 2018-59148 A 4/2018
JP 2020-105572 A 7/2020
JP 2020-168639 A 10/2020
JP 2021-31720 A 3/2021
WO WO 2021/015283 A1 1/2021

OTHER PUBLICATIONS

International Search Report for PCT/JP2022/017594 (PCT/ISA/210) dated Jun. 28, 2022.
Written Opinion of the International Searching Authority for PCT/JP2022/017594 (PCT/ISA/237) dated Jun. 28, 2022.

* cited by examiner

*Primary Examiner* — Jessee R Roe
(74) *Attorney, Agent, or Firm* — Birch, Stewart, Kolasch & Birch, LLP

(57) ABSTRACT

A high-Ni alloy having excellent weld-hot-cracking resistance includes, in mass %, Cr: 16-30%, Ni: 18-50%, Al: 0.01-1.0%, and Ti: 0.01-1.5%. In a first aspect of the invention, a relationship between number density of TiC precipitates having 1.0 μm or more of equivalent circle diameter and Mg content in steel satisfies formula (1) below. In a second aspect of the invention, S average concentration in oxide- and sulfide-inclusions is 0.70 mass % or more. In a third aspect of the invention, mass ratios of CaO, MgO, and $Al_2O_3$ in inclusions, where O or S is detected, satisfy formula (2), the mass ratios being respectively calculated from average concentrations of Ca, Mg and Al in the inclusions, (1) number density of TiC (number of pieces/$mm^2$)≤463−9.5×Mg concentration in steel (mass ppm) and (2) [CaO−0.6×MgO] (mass %)/[CaO+MgO+$Al_2O_3$] (mass %)≥0.20.

12 Claims, 3 Drawing Sheets

HIGH NICKEL ALLOY EXCELLENT IN HIGH WELDING TEMPERATURE CRACKING RESISTANCE

TECHNICAL FIELD

The present invention relates to a high nickel (Ni) alloy having an excellent weld hot cracking resistance and used as a high-temperature material.

BACKGROUND ART

A high Ni alloy is suitably used as a high-temperature material. Alloys 800 and 825 are representative commercial alloys of high Ni alloys containing Al and Ti. In recent years, demands have been expanding in developing countries and there is a need for technical development to supply inexpensive products with favorable surface quality and usability. For this reason, a manufacturing method has been converted from a conventional steel ingot method to continuous casting. Meanwhile, it is known that a high-Ni alloy manufactured by continuous casting is highly susceptible to internal slab cracks during casting, edge cracks during hot working, and surface defects of the product. Accordingly, from a viewpoint of improving productivity of a high-Ni alloy in continuous casting, improvement and development of design of chemical compositions, refining, casting, and hot working techniques of alloys have been promoted.

As patent literatures related to continuous casting techniques, for instance, Patent Literature 1 discloses a technique related to a component system and a manufacturing method in which contents of Ti, N, and Si are reduced to a low level as a method of suppressing generation of surface defects. Patent Literature 2 discloses a manufacturing method of preventing nozzle clogging and surface defects by no addition of a Ca alloy. This Literature describes disadvantages that addition of a Ca alloy causes bonding with oxygen in molten alloy to form oxide-based non-metallic inclusions, which agglomerate and increase in size, leading to generation of linear defects on a surface of an alloy sheet that is the final product. In Patent Literature 3, in order to prevent coarse agglomeration of TiN inclusions that cause generation of surface defects, CaO—MgO—$Al_2O_3$ inclusions, which are oxide inclusions, are included as essential components, and a percentage of the number of pieces of CaO and MgO in the total number of pieces of the inclusions is defined as 50% or less.

The related arts described above define the component system and the composition of inclusions from the viewpoint of productivity, especially, suppression of surface defects.

CITATION LIST

Patent Literature(s)

Patent Literature 1 JP2003-147492 A
Patent Literature 2 JP2014-189826 A
Patent Literature 3 JP2018-59148 A

SUMMARY OF THE INVENTION

Problem(s) to be Solved by the Invention

In practical use of a high Ni alloy, the inventors have found that a high Ni alloy is not only disadvantageous in productivity but also exhibits high weld hot cracking susceptibility because the high Ni alloy is austenitic single phase steel, easily causing cracks during welding work. An object of the invention is to stabilize weld hot cracking susceptibility, especially HAZ cracking susceptibility, which have not been conventionally studied, at a low level in an Al- and Ti-containing high-Ni alloy with slight amount(s) of one or both of Ca and Mg alloys.

The Al- and Ti-containing high-Ni alloy is said to have a relatively favorable hot workability. However, since a cast piece has a solidified structure, if a S content is several ppm or more, hot workability of the cast piece becomes insufficient in hot working. Accordingly, it is necessary to improve hot workability by adding a slight amount of one or both of Ca and Mg alloys. However, in a case where a high Ni alloy, which is an object of the invention, is subjected to continuous casting with addition of Ca or Mg alloy, the high Ni alloy in a form of slab, bloom or billet is processed into a steel product, and the steel product is used for manufacturing a structure by welding work, weld hot cracks may occur due to thermal stress generated by heat input. Liquefaction cracking in HAZ is sometimes raised at issue, especially, in a high-Ni alloy containing Al and Ti.

An object of the invention is to provide a high Ni alloy having an excellent weld hot cracking resistance and used as a high-temperature material.

Means for Solving the Problems

In order to clarify and solve the cause of the above issue, the inventors performed laboratory vacuum melting in which variable amounts of Ca and Mg are added to an Al- and Ti-containing high-Ni alloy of the invention as a basic composition; applied hot rolling, annealing, and heat treatment to the obtained cast piece (i.e., material) to provide a steel product; and evaluated the obtained steel product in terms of HAZ cracking susceptibility during welding according to Varestraint test. In addition, the inventors investigated non-metallic inclusions and precipitates in the alloy using FE-SEM-EDS, and studied to solve the issue.

The inventors studied and investigated the inclusions in the high-Ni alloy. As a result, the inventors have reached three aspects of the invention, namely, first to third aspects of the invention as follows.

First Aspect of Invention

Examples of oxide inclusions in a high-Ni alloy include CaO, CaO—$Al_2O_3$, MgO, CaO—MgO, and CaO—MgO—$Al_2O_3$. In addition to the oxide inclusions, TiC, TiN, or TiNC is formed individually or including the oxide inclusions. Especially, attention is paid on precipitation of a large-sized TiC that acts as a starting point of liquefaction cracking. Specifically, after each of particles is subjected to component analysis using FE-SEM-EDS, particles where Ti and C are detected and N is undetected are extracted as TiC particles. Especially, particles each having 1.0 μm or more of an equivalent circle diameter, which is calculated from an area detected as each TiC particle, are selected as large-sized TiC precipitates that can act as a starting point of HAZ cracking. The number of precipitates per unit area (i.e., number density) is investigated. A relationship between HAZ cracking susceptibility and the number density of the precipitates is evaluated. Consequently, it has been found that HAZ cracking susceptibility significantly increases when a relationship between the number density of the TiC precipitates each having 1.0 μm or more of the equivalent circle diameter and a Mg content in steel does not satisfy a formula (1) below. Further consideration has been made on an appropriate range of each alloy element, thereby having achieved the first aspect of the invention.

$$\text{Number density of TiC (number of pieces/mm}^2) \leq 463-9.5\times\text{Mg concentration in steel (mass ppm)} \quad (1)$$

Second Aspect of Invention

Examples of inclusions in a high-Ni alloy include: CaO, CaO—$Al_2O_3$, MgO, CaO—MgO, and CaO—MgO—$Al_2O_3$, each of which partially includes sulfide; and CaS. Moreover, TiC, TiN, or TiNC is formed including most of the inclusions. Among the inclusions, attention is paid on fixation capability of sulfur that increases HAZ cracking susceptibility by decreasing grain boundary strength and a melting point at grain boundaries, thereby having achieved the second aspect of the invention.

Third Aspect of Invention

Examples of oxide inclusions in the high-Ni alloy, which have been studied by the inventors, include CaO, CaO—$Al_2O_3$, MgO, CaO—MgO, and CaO—MgO—$Al_2O_3$. In addition to the oxide inclusions, TiC, TiN, or TiNC is formed individually or including the oxide inclusions. Especially, attention is paid on precipitation behavior of a large-sized TiC precipitate that acts as a starting point of liquefaction cracking. In particular, large-sized TiC precipitates that can act as a starting point of HAZ cracking are found to tend to be formed to be inclusions containing MgO or MgO and $Al_2O_3$. As a result of paying attention to the composition of the inclusions, it has been found that a favorable HAZ cracking susceptibility is obtained when an average composition of the oxide inclusions satisfies a formula (2), thereby having achieved the third aspect of the invention.

$$[\text{CaO}-0.6\times\text{MgO}](\text{mass }\%)/[\text{CaO}+\text{MgO}+\text{Al}_2\text{O}_3](\text{mass }\%) \geq 0.20 \quad (2)$$

Specifically, the gist of the invention is as follows.

[1] First Aspect of Invention

According to a first aspect of the invention, a high-Ni alloy having an excellent weld hot cracking resistance includes: in mass %, C: 0.15% or less, Si: 0.05 to 2.0%, Mn: 0.05 to 2.0%, P: 0.035% or less, S: 0.0015% or less, Cr: 16 to 30%, Ni: 18 to 50%, Al: 0.01 to 1.0%, Ti: 0.01 to 1.5%, N: 0.35% or less, O: 0.003% or less, Mo: 8% or less, Cu: 4% or less, Co: 3% or less, Ca: 0.0003 to 0.0050%, Mg: 0.0060% or less, and a balance consisting of Fe and impurities, in which a relationship between a number density of TiC precipitates each having 1.0 μm or more of an equivalent circle diameter and a Mg content in steel satisfies a formula (1) below.

$$\text{Number density of TiC (number of pieces/mm}^2) \leq 463-9.5\times\text{Mg concentration in steel (mass ppm)} \quad (1)$$

[2] Second Aspect of Invention

According to a second aspect of the invention, a high-Ni alloy having an excellent weld hot cracking resistance includes: in mass %, C: 0.15% or less, Si: 0.05 to 2.0%, Mn: 0.05 to 2.0%, P: 0.035% or less, S: 0.0015% or less, O: 0.0020% or less, O+S in total being 0.0020% or less, Cr: 16 to 30%, Ni: 18 to 50%, Al: 0.01 to 1.0%, Ti: 0.01 to 1.5%, N: 0.02% or less, Mo: 8% or less, Cu: 4% or less, Co: 3% or less, Ca: 0.0010 to 0.0050%, Mg: 0.0010 to 0.0050%, and a balance consisting of Fe and impurities, in which an average concentration of S in oxide inclusions and sulfide inclusions is 0.70 mass % or more.

[3] Third Aspect of Invention

According to a third aspect of the invention, a high-Ni alloy having an excellent weld hot cracking resistance includes: in mass %, C: 0.15% or less, Si: 0.05 to 2.0%, Mn: 0.05 to 2.0%, P: 0.035% or less, S: 0.0015% or less, Cr: 16 to 30%, Ni: 18 to 50%, Al: 0.01 to 1.0%, Ti: 0.01 to 1.5%, N: 0.35% or less, O: 0.003% or less, Mo: 8% or less, Cu: 4% or less, Co: 3% or less, Ca: 0.0003 to 0.0050%, Mg: 0.0045% or less, and a balance consisting of Fe and impurities, in which mass ratios of CaO, MgO, and $Al_2O_3$ in inclusions, where O or S is detected, satisfy a formula (2), the mass ratios being respectively calculated from an average Ca concentration, an average Mg concentration, and an average Al concentration in the inclusions.

$$[\text{CaO}-0.6\times\text{MgO}](\text{mass }\%)/[\text{CaO}+\text{MgO}+\text{Al}_2\text{O}_3](\text{mass }\%) \geq 0.20 \quad (2)$$

[4] Common to First to Third Aspects of Invention

The high-Ni alloy having an excellent weld hot cracking resistance according to any one of [1] to [3] further includes: in place of a part of the Fe, in mass %, one or more of B: 0.0002 to 0.0030%, Sn: 0.05% or less, Zn+Pb+Bi: 0.0010% or less, Zr: 0.5% or less, Hf: 0.5% or less, La+Ce+Nd: 0.0050% or less, W: 3% or less, V: 0.01 to 0.5%, Nb: 0.002 to 1.0%, and Ta: 0.002 to 1.0%.

[5] In the high-Ni alloy having an excellent weld hot cracking resistance according to any one of [1] to [3], the high-Ni alloy is used in a welded structure.

[6] In the high-Ni alloy having an excellent weld hot cracking resistance according to [4], the high-Ni alloy is used in a welded structure.

The first to third aspects of the invention facilitate stably manufacturing a welded structure using an Al- and Ti-containing high-Ni alloy used as a high-temperature material. The first to third aspects of the invention can provide an Al- and Ti-containing high-Ni alloy that is excellent in hot workability, is less likely to generate cracking in a heat-affected zone when manufacturing a welded structure, and is excellent in creep properties and oxidation resistance at high temperatures.

BRIEF DESCRIPTION OF DRAWING(S)

DESCRIPTION OF EMBODIMENT(S)

Figure 1:
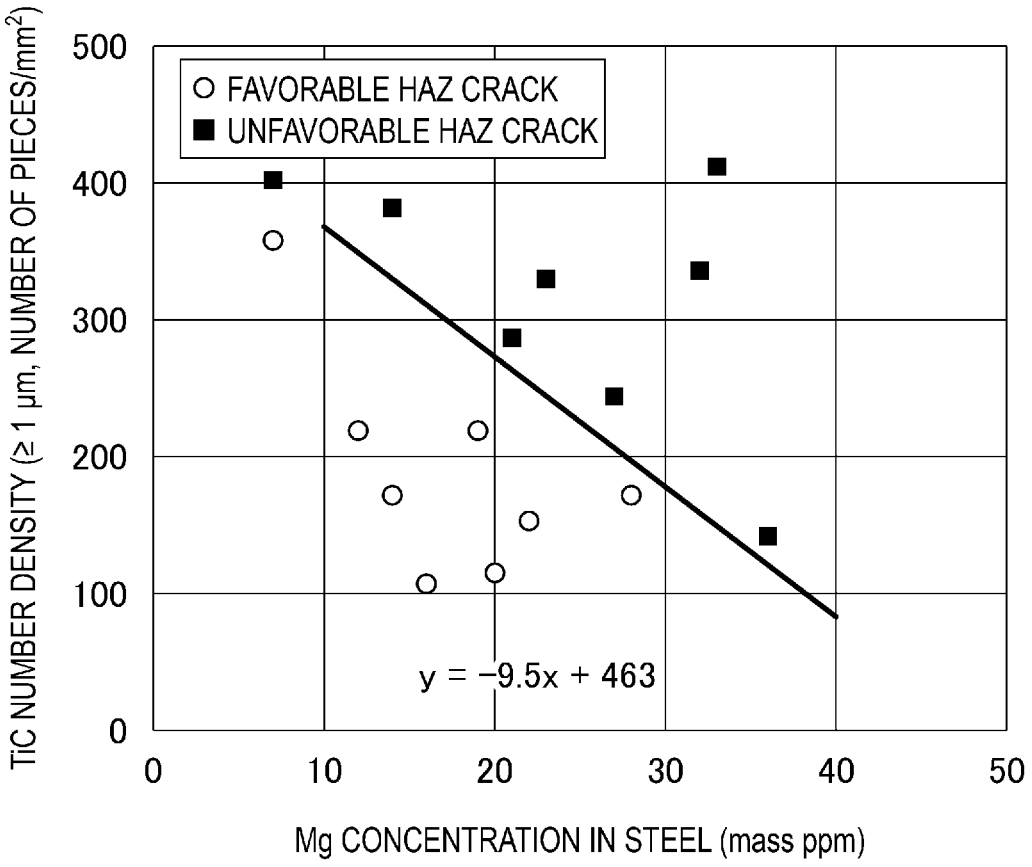
FIG. 1 illustrates a relationship between a Mg concentration in steel, TiC number density, and a total length of HAZ cracks.

Firstly, the invention is defined below. A content of each of components is shown by mass %.

Common Component Composition in First to Third Aspects of Invention

C: 0.15% or less

C is added in order to ensure strength of a high-temperature material and a heat resistant alloy. In particular, when a high-temperature strength property is required, a C content is added at 0.015% or more, preferably 0.05% or more. The upper limit of the C content is limited to 0.15% or less. In this alloy, C is present in a form of TiC precipitate. The C content exceeding 0.15% generates Cr carbides to deteriorate a high-temperature property and corrosion resistance. The C content is preferably 0.10% or less, more preferably 0.085% or less.

Si: from 0.05 to 2.0%

A Si content is added at 0.05% or more, preferably 0.2% or more, in order to improve deoxidation and oxidation resistance. When the Si content exceeding 2.0% is added, solidification cracking susceptibility of steel is deteriorated and an intermetallic compound easily precipitates, deteriorating a high-temperature property. Accordingly, the upper limit of the Si content is limited to 2.0%. The upper limit of the Si content is preferably 1.5%, more preferably 0.8%.

Mn: from 0.05 to 2.0%

Mn has an effect of increasing stability of an austenite phase and improving heat resistance. For this reason, it is preferable to positively add Mn in the alloy of the invention. In order to improve heat resistance, a Mn content is added at 0.05% or more, preferably 0.2% or more, more preferably 0.3% or more. However, when the Mn content exceeding 2.0% is added, an intermetallic compound easily precipitates, deteriorating heat resistance. Accordingly, the upper limit of the Mn content is defined as 2.0%. The upper limit of the Mn content is preferably 1.5%, more preferably 1.3%.

P: 0.035% or less

P is an element that is unavoidably mixed into steel from raw materials and increases solidification cracking susceptibility. Accordingly, a P content is limited to 0.035% or less, preferably 0.030% or less.

S: 0.0015% or less

S, which is an element that is unavoidably mixed into steel from raw materials, deteriorates hot workability and oxidation resistance and increases HAZ cracking susceptibility by segregation of S in grain boundaries. Therefore, a S content needs to be reduced to the minimum. The S content is thus limited to 0.0015% or less, preferably 0.0010% or less. Although the S content is reducible by refining, an extreme reduction of the S content results in an increase in production costs. The lower limit of the S content is preferably 0.0003% in consideration of an increase in production costs.

Cr: from 16 to 30%

Cr is an essential element for exhibiting oxidation resistance of a heat-resistant alloy as a high-temperature material. A Cr content is 16% or more, preferably 18% or more. On the other hand, with the Cr content exceeding 30%, a structure stability under a high temperature decreases even with a large content of Ni, and an intermetallic compound easily precipitates, deteriorating heat resistance. The upper limit of the Cr content is preferably 28%, more preferably 26%. It should be noted that an optimum content of Cr depends on a content of each of Ni, Si, Mo, and other elements. For instance, for a Ni content of about 30%, the Cr content of about 20% is optimum. Alternatively, for a Ni+Cu content of about 45%, a Cr+Mo content of about 25% is optimum.

Ni: from 18 to 50%

Ni stabilizes an austenite structure obtained at a high temperature and also improves toughness and corrosion resistance to various acids. Accordingly, a Ni content is 18% or more, preferably 20% or more, more preferably 25% or more. An increase in the Ni content enables Cr, Mo, Al, and Ti necessary for heat resistance to be contained at a larger amount. On the other hand, since a Ni alloy is expensive, the upper limit of the Ni content is defined as 50%, preferably 48%, more preferably 45% in terms of production costs in steel of the invention.

Al: from 0.01 to 1.0%

Al, which is a deoxidation element, forms a NiAl ordered phase in a high-Ni alloy and increases high-temperature strength. An Al content needs to be 0.01% or more, preferably 0.05% or more, in order to control a composition of an oxide to improve hot workability. On the other hand, with the Al content exceeding 1.0%, an intermetallic compound easily precipitates, deteriorating heat resistance. Moreover, an excessive Al content deteriorates weld hot cracking susceptibility, specifically HAZ cracking susceptibility during welding in the invention. Accordingly, the upper limit of the Al content is defined as 1.0%, preferably 0.60%.

Ti: from 0.01 to 1.5%

Ti forms a NiTi ordered phase in a high-Ni alloy and increases high-temperature strength. Accordingly, a Ti content needs to be 0.01% or more, preferably 0.15% or more. In the second aspect of the invention, more preferably, a total of the Al content and the Ti content is 0.80% or more. On the other hand, with the Ti content exceeding 1.5%, an intermetallic compound easily precipitates, deteriorating heat resistance. Moreover, an excessive Ti content deteriorates weld hot cracking susceptibility, specifically HAZ cracking susceptibility during welding in the invention. The upper limit of the Ti content is preferably 1.0%.

Mo: 8% or less

Mo is an element for increasing strength of a heat-resistant alloy. When Mo is added in order to improve heat resistance, a Mo content is 0.05% or more, preferably 0.2% or more. Since Mo is an expensive element, the upper limit of the Mo content is defined as 8% in order to reduce production costs of alloys in steel of the invention. The upper limit of the Mo content is preferably 3%, more preferably 2%. Mo may not be contained.

Cu: 4% or less

Cu is an element for increasing corrosion resistance of an alloy to acid and dewpoint corrosion resistance of an alloy which is often problematic in a high-temperature device, and also an element for improving high-temperature strength and structure stability. When Cu is added in order to improve heat resistance and corrosion resistance, a Cu content is 0.05% or more, preferably 0.1% or more. On the other hand, when the Cu content exceeding 4% is added, embrittlement occurs at the time of solidification. Accordingly, the upper limit of the Cu content is defined as 4%. The upper limit of the Cu content is preferably 3.0%, more preferably 2.0%. Cu may not be contained.

Co: 3.0% or less

Co is an effective element for increasing high-temperature structure stability and corrosion resistance of an alloy. When Co is added in order to improve these characteristics, a Co content is 0.1% or more. Since Co is an expensive element, a Co content exceeding 3.0% does not produce an effect commensurate with costs. Accordingly, the upper limit of the Co content is defined as 3.0%. The upper limit of the Co content is preferably 1.5%. Co may not be contained.

Component Composition Defined in First Aspect of Invention

N: 0.35% or less

N is an effective element for improving high-temperature strength. A N content can be added up to 0.35%. It should be noted that Ti and Al are positively added in the invention. When Al or Ti is added at a content of 0.3% or more in total, N becomes a harmful element forming AlN or TiN, which is a non-metallic inclusion, to deteriorate characteristics of materials, and combining with oxides to promote nozzle clogging during continuous casting. Accordingly, when Al or Ti is added at a content of 0.3% or more, the upper limit of a N content is preferably 0.02% or less, more preferably 0.01% or less.

O: 0.003% or less

Oxygen forms oxide inclusions with Ca, Mg, Al, and Ti in the alloy of the invention. An oxygen content depends on a total weight of oxide inclusions and is an important indicator of a deoxidized state of the alloy. With the oxygen content exceeding 0.003%, a desired deoxidation equilibrium is not satisfied and nozzle clogging easily occurs during continuous casting. In addition, oxygen contained in steel promotes generation of coarse TiC precipitates. Also regarding weld hot cracking susceptibility, which is the essence of the invention, coarse TiC precipitates act as a starting point of liquefaction cracking that is a main factor in an increase in hot cracking susceptibility. Accordingly, the upper limit of the oxygen content is defined as 0.003%, preferably 0.0025%. On the other hand, an excessive reduction in the oxygen content causes Ca and Mg to easily excessively occur in the alloy. This leads to preferential formation of MgO inclusions to rather increase the number of coarse TiC inclusions, or promotes grain boundary segregation of excessive Mg to decrease grain boundary strength, whereby weld hot cracking susceptibility may be rather increased. Accordingly, in order to stabilize weld hot cracking susceptibility at a low level, the lower limit of the oxygen content is preferably 0.0005%.

Ca: from 0.0003 to 0.0050%

Ca is an important element for improving hot workability and weld hot cracking susceptibility of the alloy, and is contained in order to fix S in the alloy in a form of CaS and improve hot workability. This reaction is performed as follows. Ca is bonded with oxygen in the alloy to form CaO and CaO—$Al_2O_3$ and decrease dissolved oxygen (free oxygen) in the alloy. After the dissolved oxygen (free oxygen) in the alloy is reduced to almost zero, the remaining Ca reacts with S in the alloy to form CaS. For the above purpose in the alloy of the invention, a Ca content is 0.0003% or more, preferably 0.0010% or more. On the other hand, excessive addition of Ca not only causes manufacturing disadvantages such as nozzle clogging but also increases CaO—MgO—$Al_2O_3$ inclusions or increases liquefaction cracking susceptibility due to grain boundary segregation of excessive Ca, and deteriorates hot workability at about 1100 degrees C. Accordingly, the upper limit of the Ca content is defined as 0.0050%.

Mg: 0.0060% or less

Mg is generally capable of improving hot workability of alloys when contained at a slight amount. In the invention, addition of Mg produces an adverse effect of promoting formation of MgO inclusions that increase HAZ cracking susceptibility during welding. Moreover, extra Mg not forming oxides segregates at grain boundaries to reduce grain boundary strength in a high-temperature range (e.g., 900 degrees C.), thereby reducing hot workability and increasing HAZ cracking susceptibility in the high-temperature range. When deoxidation is reinforced as described later in manufacture of the steel of the invention, Mg is inevitably picked up from slag, furnace walls, and the like. In view of the above findings, the Mg content needs to be reduced to the minimum, and Mg is not added to the alloy in the invention. The lower limit of the Mg content is not determined. The upper limit of the Mg content is preferably 0.0060%, more preferably 0.0040%, and still more preferably 0.0030%.

Precipitates Defined in First Aspect of Invention $$\text{Number density (number of pieces/mm}^2\text{) of TiC} \leq 463 - 9.5 \times \text{Mg concentration in steel (mass ppm)} \quad (1)$$

A number density (number of pieces/$mm^2$) of TiC refers to a number density of particles containing Ti and C with no N detected (TiC precipitates (each having an equivalent circle diameter of 1.0 μm or more)), among particles each having an equivalent circle diameter of 1.0 μm or more which are extracted by FE-SEM-EDS in a certain measurement field of an alloy cross section.

Here, a formation process of TiC will be described. TiN is preferentially formed in a high-temperature liquid phase, whereas TiC precipitates in a solid-liquid coexistence region and a solid-phase region. Most of TiC are fine precipitates each having a size of about 0.2 μm or smaller. On the other hand, TiC formed partially in a high-temperature range is mostly formed surrounding other inclusions, and some of the TiC precipitates obtained are coarsened to about 1 μm to several μm. When thus coarsened TiC precipitates are present at grain boundaries, C and Ti in TiC diffuse into a matrix due to heat input during welding to lower a melting point of an interface of TiC and the matrix, resulting in a starting point of liquefaction cracking generated in an HAZ portion.

A particle diameter of TiC affecting liquefaction cracking will be described. When the equivalent circle diameter of TiC is less than 1.0 μm, since C diffuses into a bulk and TiC disappears before eutectic melting occurs at the interface with the alloy, TiC does not act as the starting point of liquefaction cracking and has almost no effect on HAZ cracking susceptibility. On the other hand, as the particle diameter of TiC particles is larger, the number thereof is smaller and probability of TiC existing at the interface of weld metal and the base metal also decreases sharply. The number of pieces of TiC having the equivalent circle diameter of 5 μm or more is only less than 1% relative to the number of pieces of TiC having the equivalent circle diameter of 1 to 5 μm. Accordingly, an effect of TiC having the equivalent circle diameter of 5 μm or more on HAZ cracking susceptibility can be ignored.

For instance, in Patent Literature 3, MgO inclusions and CaO inclusions serve as nuclei for forming TiN inclusions, whereas CaO—$Al_2O_3$—MgO inclusions do not become nuclei for forming TiN inclusions and are regarded as being harmless. Therefore, a composition of the CaO—MgO—$Al_2O_3$ inclusions is adjusted in order to prevent TiN from being coarsened. Smelting conditions are determined so as to stably form CaO—MgO—$Al_2O_3$ inclusions having such a composition that a melting point is lower than the temperature region where TiN is formed. This inhibits formation of oxides (i.e., CaO and MgO) that are to serve as inoculation nuclei for forming coarse TiN inclusions. However, while TiN is mostly formed in a temperature region higher than a solidification start temperature of a matrix phase, most of TiC precipitates are formed at a temperature equal to or less than the solidification start temperature of the matrix phase. For the TiC precipitates, even CaO—MgO—$Al_2O_3$ inclusions act as inoculation nuclei, thereby forming coarsened TiC precipitates including CaO—MgO—$Al_2O_3$ inclusions at grain boundaries. Accordingly, the method of Patent Literature 3 is not effective as a method for improving HAZ cracking susceptibility. It is important to reduce the number of inclusions that can act as inoculation nuclei for forming TiC precipitates, more specifically, the number of inclusions that easily form coarse TiC precipitates.

Mg present in molten steel as free Mg that is not bonded to oxygen segregates in grain boundaries, thereby decreasing the grain boundary strength. It is also necessary to consider an effect caused by this decrease in the grain boundary strength. In order to prevent the decrease in the grain boundary strength caused by segregation of free Mg into the grain boundaries, it is effective to decrease the Mg content per se in steel.

As described above, it is necessary to compositely consider the adverse effects caused by both of the coarse TiC inclusions and Mg segregation as a factor causing the adverse effects on the HAZ cracking susceptibility. As a result of diligent studies by the inventors, it has been revealed that HAZ cracking susceptibility is favorably improved when a relationship between a number density of TiC precipitates each having 1.0 μm or more of an equivalent circle diameter and a Mg content in steel satisfies a formula (1) below. That is, the grain boundary strength decreases as the Mg content increases and it is necessary to further reduce the number of coarse TiC that is to serve as starting points for cracks. It should be noted that the target inclusions are particles where N is undetected and only C is detected. Specifically, it suffices to target only TiC precipitate particles that contain only N at a level at which no difference from the background is observed in quantitative analysis by FE-SEM-EDX. TiNC precipitate particles containing TiN may be excluded.

$$\text{Number density of TiC (number of pieces/mm}^2) \leq 463 - 9.5 \times \text{Mg concentration in steel (mass ppm)} \quad (1)$$

Reduction of the oxygen concentration by reinforcing deoxidation during refining is an effective means for decreasing the number density of inclusions in steel. In reinforcement of deoxidation, deoxidation ability is reinforced by adding Ca alloys, in addition to deoxidizing with Si and Al. On the other hand, when oxygen partial pressure in molten steel is lowered by deoxidation reinforcement, Mg is picked up from slag, furnace walls, and the like. Mg contained in the molten steel forms oxide inclusions such as CaO—MgO—$Al_2O_3$ and MgO. Here, a ratio of the number of MgO inclusions to the number of CaO—MgO—$Al_2O_3$ inclusions increases as the oxygen partial pressure decreases. The inventors have statistically checked, using FE-SEM-EDS, a composition of inclusions that serve as inoculation nuclei of TiC precipitates. As a result, a ratio of TiC containing MgO increases as the particle diameter of TiC increases. On the other hand, it has been confirmed that a ratio of TiC containing only CaO and not containing MgO decreases as the particle diameter of TiC increases. As described above, an amount of TiC precipitates sharply increases in a solid phase temperature region below a melting point in a solidification process during casting. At that time, if there are inclusions that are compatible with TiC (i.e., crystal mismatch degree between the inclusions and TiC is small), nucleation and growth occur at a higher temperature at an early stage, and therefore the TiC precipitates tend to become coarse. These compatible inclusions are considered to be MgO. Since TiC present at grain boundaries produces larger adverse effects on the liquefaction cracking susceptibility as the particle diameter of TiC increases, the means for suppressing generation of MgO or inclusions containing MgO, which promotes formation of coarse TiC, is effective for favorably improving the HAZ cracking susceptibility.

Accordingly, in order to reduce the number density of TiC each having the equivalent circle diameter of 1.0 μm or more, it is effective to suppress formation of MgO or inclusions containing MgO. Therefore, it is necessary to prevent Mg from being picked up into the molten steel while reducing the oxygen concentration in the molten steel. As described above, in order to prevent the decrease in the grain boundary strength caused by segregation of free Mg into the grain boundaries, it is effective to decrease the Mg content per se. In order to reduce the Mg content, it is important to manufacture steel under conditions of suppressing pick-up of Mg.

A manufacturing method of the first aspect of the invention will be described below.

In order to achieve both the decrease in the oxygen concentration and the suppression of Mg pick-up, after sufficient deoxidation and desulfurization using Al and Ti, which have stronger deoxidization power than Si, during the secondary refining, deoxidation and desulfurization by adding Ca are performed immediately before the completion of the secondary refining or during the continuous casting. Since Ca reacts more easily with oxygen than Mg, the oxygen concentration can be reduced by deoxidizing with Ca without using Mg. In addition, the slag formed on the surface of the molten steel in a ladle during the secondary refining needs to be produced with a slag composition that can minimize Mg pick-up that occurs during the secondary refining. Specifically, it is necessary to manage the slag with the slag composition in which the MgO contained in the slag is minimized. MgO in the slag is preferably 10% or less. When basicity of the slag composition is increased, it is necessary to restrict an input amount of MgO even more severely. On the other hand, since MgO is unavoidably mixed in from bricks of a slag line of a ladle or raw materials, it is necessary to suppress Mg pick-up into steel, assuming that MgO to be mixed in the slag is about 5 to 10%. For this purpose, the basicity of the slag is preferably rather low. Specifically, it is desirable that the mass ratio C/A of CaO and $Al_2O_3$ in the slag is 1.5 or less, preferably 1.0 or less. In addition, the mass ratio C/S of CaO and $SiO_2$ in the slag is 4 or less, preferably 2 or less, and deoxidation and desulfurization are favorably performed to the extent that the total amount in mass % of oxygen and sulfur in the molten steel is 15 to 35 ppm. Further, the Mg concentration in the molten steel sometimes increases due to Mg pick-up from the slag immediately after Ca is added to the molten steel. Therefore, it is preferable to add Ca to the molten steel in the final step of the secondary refining rather than in the continuous casting. Even in that case, it is preferable to add Ca five minutes or more before the transition to continuous casting. It should be noted that $CaF_2$ for adjusting the melting point can be added within a range where the furnace body is not damaged.

Component Composition Defined in Second Aspect of Invention

N: 0.02% or less

N is an effective element for improving high-temperature strength and corrosion resistance. Ti and Al are positively added in the second aspect of invention. In this case, N becomes a harmful element forming AlN or TiN, which is a non-metallic inclusion, to deteriorate characteristics of materials, and combining with oxides to promote nozzle clogging during continuous casting. Accordingly, the upper limit of the N content is defined as 0.02%. The N content is preferably 0.01% or less.

O: 0.0020% or less, O+S: 0.0020% or less

Oxygen forms oxide inclusions with Ca, Mg, Al, and Ti in the alloy of the invention. An oxygen content depends on a total weight of oxide inclusions and is an important indicator of a deoxidized state of the alloy. In addition, the oxide inclusions adversely affect plate processing and tube expandability. Further, in order to suppress segregation of S in the grain boundaries as much as possible in the invention, desulfurization is promoted by fixing sulfur with Ca as described later. For this purpose, the upper limit of the oxygen content needs to be 0.0020%. A value of O+S needs to be 0.0020% or less as an index for determining whether the sulfur fixation with Ca is fully performed in steel that has been deoxidized such that oxygen becomes equal to or less than 0.0020%. On the other hand, excessive deoxidation may reduce Ca and Mg contained in the furnace body and slag to generate excessive Ca and Mg in the alloy. In this case, conversely, hot workability and weld hot cracking susceptibility are deteriorated. Accordingly, the oxygen content is preferably 0.0003% or more.

Ca: from 0.0010 to 0.0050%

Ca is an important element for improving hot workability and weld hot cracking susceptibility of the alloy, especially, HAZ cracking susceptibility during welding in the invention. Ca is contained to fix S in the alloy in a form of CaS and improve hot workability. This reaction is performed as follows. Ca is bonded with oxygen in the alloy to form CaO and CaO—$Al_2O_3$ and decrease dissolved oxygen (free oxygen) in the alloy. After the dissolved oxygen (free oxygen) in the alloy is reduced to almost zero, the remaining Ca reacts with S in the alloy to form CaS. For the above effects in the alloy of the invention, a Ca content is 0.0010% or more, preferably 0.0015% or more. On the other hand, excessive addition of Ca lowers ductility at high temperatures near 1100 degrees C. Accordingly, the upper limit of the Ca content is defined as 0.0050%.

Mg: from 0.0010 to 0.0050%

Mg of 0.0010% or more is contained in the invention since Mg is picked up through strong deoxidation. Mg is generally capable of improving hot workability of alloys when contained at a slight amount. However, in the invention, Mg adversely promotes forming MgO inclusions that deteriorate HAZ cracking susceptibility during welding. Moreover, extra Mg not forming oxides segregates in a grain boundary to reduce grain boundary strength in a high-temperature range (e.g., 900 degrees C.), thereby reducing hot workability and deteriorating HAZ cracking susceptibility in the high-temperature range. Accordingly, the upper limit of the Mg content is determined as 0.0050%, preferably 0.0040%.

Sulfur Concentration in Inclusions Defined in Second Aspect of Invention

Sulfur Average Concentration in Oxide Inclusions and Sulfide Inclusions: 0.70% or More A sulfur average concentration in inclusions refers to an average concentration of sulfur that is contained in oxide inclusions with oxygen, sulfide inclusions with sulfur, and precipitates formed with inclusions as inoculation nuclei and that is obtained by FE-SEM-EDS analysis in a certain measurement field of an alloy cross section. In steel in which the oxygen concentration and the sulfur concentration are defined to be 0.0020 mass % or less in total, sulfur is fixed in inclusions so that the sulfur average concentration in the inclusions is 0.70 mass % or more, whereby grain boundary segregation of sulfur, which adversely affects HAZ cracking during welding, can be suppressed, enabling to maintain a favorable resistance to HAZ cracking.

Reduction of the oxygen concentration by reinforcing deoxidation during refining is an effective means for fixing sulfur in inclusions.

A manufacturing method of the second aspect of the invention will be described below. In reinforcement of deoxidation, deoxidation power is reinforced by adding Ca, which has a high ability to fix S, in addition to deoxidizing with Al. Deoxidation and desulfurization by addition of Ca alloy before the final secondary refining process or during continuous casting are effective. In addition, a composition of slag formed on a surface of molten steel during the secondary refining needs to be a slag composition with a high basicity which generates CaO-rich inclusions. A ratio (C/A) of CaO to $Al_2O_3$ in mass in the slag is preferably 1.5 or more, more preferably 2.0 or more. It should be noted that $CaF_2$ for adjusting the melting point can be added within a range where the furnace body is not damaged. In addition, the Mg concentration may increase due to Mg pick-up from the slag immediately after Ca addition. It is preferable to add Ca in the final step of the secondary refining rather than in continuous casting. Even in that case, it is preferable to add Ca five minutes or more before the transition to continuous casting.

Component Composition Defined in Third Aspect of Invention

N: 0.35% or less

N is an effective element for improving high-temperature strength. An N content can be added up to 0.35%. It should be noted that Ti and Al are positively added in the third aspect of the invention. When Al or Ti is added at a content of 0.3% or more in total, N becomes a harmful element forming AlN or TiN, which is a non-metallic inclusion, to deteriorate characteristics of materials, and combining with oxides to promote nozzle clogging during continuous casting. Accordingly, when Al or Ti is added at a content of 0.3% or more in total, the upper limit of the N content is preferably 0.02% or less, more preferably 0.01% or less.

O: 0.003% or less

Oxygen forms oxide inclusions with Ca, Mg, Al, and Ti in the alloy of the invention. An oxygen content depends on a total weight of oxide inclusions and is an important indicator of a deoxidized state of the alloy. When the oxygen content exceeds 0.003%, a desired deoxidation equilibrium is not satisfied and nozzle clogging easily occurs during continuous casting. In addition, a high oxygen content promotes generation of coarse TiC precipitates. Coarse TiC precipitates act as starting points for liquefaction cracking, which is the main cause of deterioration in hot cracking susceptibility. Accordingly, the high oxygen content also adversely affects weld hot cracking susceptibility that is the essence of the invention. Accordingly, the upper limit of the oxygen content is defined as 0.003%, preferably 0.0025%, more preferably 0.002%. A decrease in the oxygen content leads to a decrease in the oxide inclusions and coarse TiC inclusions, which is advantageous in suppressing nozzle clogging and weld hot cracking, however, generates excessive Ca and excessive Mg in the alloy to become a factor of deteriorating hot workability. Accordingly, the oxygen content is preferably 0.0003% or more.

Ca: from 0.0003 to 0.0050%

Ca is an important element for improving hot workability and weld hot cracking susceptibility of the alloy, and is contained in order to fix S in the alloy in a form of CaS and improve hot workability. This reaction is performed as follows. Ca is bonded with oxygen in the alloy to form CaO and CaO—$Al_2O_3$ and decreases dissolved oxygen (free oxygen) in the alloy. After the dissolved oxygen (free oxygen) in the alloy is reduced to almost zero, the remaining Ca reacts with S in the alloy to form CaS. For the above effects in the alloy of the invention, a Ca content is 0.0003% or more, preferably 0.0010% or more, more preferably 0.0015% or more. On the other hand, excessive addition of Ca lowers ductility at high temperatures near 1100 degrees C. Accordingly, the upper limit of the Ca content is defined as 0.0050%, preferably 0.0045%.

Mg: 0.0045% or less

Mg is generally capable of improving hot workability of alloys when contained at a slight amount. In the invention, addition of Mg promotes formation of MgO inclusions, and consequently produces an adverse effect of deteriorating HAZ cracking susceptibility during welding. In addition, extra Mg not forming oxides segregates at grain boundaries. Mg segregating at the grain boundaries reduces grain boundary strength in a high-temperature range (e.g., 900 degrees C.), thereby reducing hot workability and deteriorating HAZ cracking susceptibility in the high-temperature range. When deoxidation is reinforced as described later in manufacture of the steel of the invention, Mg is inevitably picked up from slag, furnace walls, and the like into the steel. In view of the above findings, the Mg content needs to be reduced to the minimum, and Mg is not added to the alloy in the invention. The upper limit of the Mg content is determined as 0.0045%, preferably 0.0040%.

Composition Ratio of Inclusions Defined in Third Aspect of Invention $$[CaO-0.6\times MgO](\text{mass }\%)/[CaO+MgO+Al_2O_3](\text{mass }\%)\geq 0.20 \quad (2)$$

A value of the left side of the above formula (2) ([CaO−0.6×MgO] (mass %)/[CaO+MgO+$Al_2O_3$] (mass %)) is calculated as follows. Inclusions in which O or S is detected are extracted by FE-SEM-EDS analysis in a certain measurement field of an alloy cross section. Assuming that Ca, Mg, and Al are respectively in a form of CaO, MgO, and $Al_2O_3$, mass ratios of CaO, MgO, and $Al_2O_3$ in the inclusions are calculated from the Ca, Mg, and Al average concentrations in the extracted inclusions, and a relationship between CaO, MgO, and $Al_2O_3$ is derived.

Here, a formation process of TiC will be described. In the process of solidification of molten steel, TiN is preferentially formed in a high-temperature liquid phase, whereas TiC precipitates in a solid-liquid coexistence region and a solid-phase region. Most of TiC is finely precipitated with a size of about 0.2 μm or less. However, TiC formed partially in a high-temperature range is mostly formed surrounding oxide inclusions, and some of the TiC precipitates obtained are coarsened to about 1 μm to several μm. When thus coarsened TiC precipitates are present at the grain boundaries, C and Ti in TiC diffuse into a matrix due to heat input during welding to lower a melting point of an interface of TiC and the matrix, resulting in a starting point of liquefaction cracking generated in the HAZ portion.

In contrast, for instance, as described above in Patent Literature 3, MgO inclusions and CaO inclusions serve as nuclei for forming TiN inclusions, whereas CaO—$Al_2O_3$-MgO inclusions do not become nuclei for forming TiN inclusions and are regarded as being harmless. Therefore, a composition of the CaO—MgO—$Al_2O3$ inclusions is adjusted in order to prevent TiN from being coarsened. Smelting conditions are determined so as to stably form the CaO—MgO—$Al_2O_3$ inclusions having a composition such that a melting point is lower than the temperature region where TiN is formed. This inhibits formation of oxides (i.e., CaO and MgO) serving as nuclei during formation of coarse TiN inclusions. However, while TiN is mostly formed in a temperature region higher than a solidification start temperature of a matrix phase, most of TiC precipitates are formed at a temperature equal to or less than the solidification start temperature of the matrix phase. For the TiC precipitates, even CaO—MgO—$Al_2O_3$ inclusions act as inoculation nuclei, thereby forming a lot of coarsened TiC precipitates including CaO—MgO—$Al_2O_3$ inclusions as inoculation nuclei at grain boundaries. Accordingly, the method of Patent Literature 3 is not effective as a method for improving HAZ cracking susceptibility. It is important in the invention to reduce the number of inclusions that can act as inoculation nuclei for forming TiC precipitates, more specifically, the number of inclusions that are likely to form coarse TiC precipitates. Mg present in molten steel as free Mg that is not bonded to oxygen segregates in grain boundaries, thereby decreasing the grain boundary strength. It is also necessary to also consider an effect caused by this decrease in the grain boundary strength.

Reduction of the oxygen concentration by reinforcing deoxidation during refining is an effective means for decreasing the number of inclusions. In reinforcement of deoxidation, deoxidation power is reinforced by adding a Ca alloy, in addition to deoxidizing with Al. Meanwhile, reduction of oxygen partial pressure in the molten steel causes Mg pick-up from the slag, the furnace wall and the like into the molten steel. Mg in the molten steel forms oxide inclusions such as CaO—MgO—$Al_2O_3$ and MgO. A ratio in number of MgO inclusions to CaO—MgO—$Al_2O_3$ inclusions increases as the oxygen partial pressure decreases. The inventors statistically checked, using FE-SEM-EDS, a relationship between a composition of inclusions that are nuclei of the TiC precipitates and a particular diameter of TiC. As a result, it was found that as the particle diameter of TiC increases, the ratio of TiC containing MgO or MgO and $Al_2O_3$ increases, whereas the ratio of TiC containing only CaO without MgO and $Al_2O_3$ decreases. Since TiC present at grain boundaries produces more adverse effects on the liquefaction cracking susceptibility as the particle diameter of TiC increases, the means for suppressing generation of MgO, which promotes formation of coarse TiC, is effective for favorably improving the HAZ cracking susceptibility.

A particle diameter of TiC affecting liquefaction cracking will be described. When the equivalent circle diameter of TiC is less than 1 μm, since C diffuses into a bulk and TiC disappears before eutectic melting occurs at the interface with the alloy, TiC scarcely acts as the starting point of liquefaction cracking and therefore has almost no effect on liquefaction cracking susceptibility. On the other hand, as the diameter of TiC particles is larger, the number thereof is smaller and probability of TiC existing at the interface of weld metal and the base metal also decreases sharply. The number of TiC particles having the equivalent circle diameter of 5 μm or more is only less than 1% relative to the number of TiC particles having the equivalent circle diameter of 1 to 5 μm. Accordingly, an effect of TiC particles having the equivalent circle diameter of 5 μm or more on liquefaction cracking susceptibility can be ignored.

In order to prevent the decrease in the grain boundary strength caused by segregation of free Mg into the grain boundaries, it is effective to decrease the Mg content per se in steel. In order to decrease the Mg content, it is important to manufacture steel under conditions for suppressing Mg pick-up.

As described above, it is necessary to compositely consider the adverse effects caused by both of the coarse TiC inclusions and Mg segregation as a factor causing the adverse effects on the HAZ cracking susceptibility in the third aspect of the invention. As a result of diligent studies by the inventors, it has been found that when the mass ratios of CaO, MgO, and $Al_2O_3$ calculated from the Ca, Mg, and Al average concentrations in the inclusions satisfy the formula (2), coarse TiC is less likely to precipitate and HAZ cracking susceptibility is significantly reduced.

$$[CaO-0.6\times MgO](\text{mass }\%)/[CaO+MgO+Al_2O_3](\text{mass }\%)\geq 0.20 \quad (2)$$

Since excessive Ca addition may cause disadvantages such as nozzle clogging, the upper limit of the Ca ratio in the inclusions preferably satisfies $0.90\geq[CaO]$ (mass %)/[CaO+MgO+$Al_2O_3$] (mass %).

A manufacturing method of the third aspect of the invention will be described below.

In order to achieve both the decrease in the oxygen concentration and the suppression of Mg pick-up, after sufficient deoxidation and desulfurization using Al and Ti, which have stronger deoxidization power than Si, during the secondary refining, deoxidation and desulfurization by adding Ca are requisite immediately before the completion of the secondary refining or during the continuous casting. In addition, the slag formed on the surface of the molten steel in a ladle during the secondary refining needs to be produced with a slag composition that can minimize pick-up of Mg that occurs during the secondary refining. Specifically, the slag needs to be managed with a slag composition in which MgO contained in the slag is reduced as much as possible. As the basicity of the slag composition is higher, the added amount of MgO needs to be further limited. With the slag composition having a high basicity, specifically, when the mass ratio C/A between CaO and $Al_2O_3$ in the slag is 1.0 or more, the mass ratio C/S between CaO and $SiO_2$ is 11.2 or more, and the ratio between $Al_2O_3$ and MgO in the slag is defined as A/M, it is necessary to limit the MgO content in the slag so as to satisfy $A/M\geq 4.0$ in the steel containing Al and Ti falling within the range of the third aspect of the invention and to add Ca alloys immediately before the completion of the secondary refining. It should be noted that addition of $CaF_2$ for adjusting the melting point is required in a range (10 to 25 mass %) in which the furnace body is not damaged.

The inclusion composition that satisfies the formula (2) is achievable by using the manufacturing method described above.

Common Component Composition in First to Third Aspects of Invention

The component composition of the high Ni alloy of the invention contains the above-mentioned components, and the balance consists of Fe and impurities. Further, in place of a part of Fe above, the following components (mass %) can be selectively contained. Next, reasons for defining the selective components will be described.

B: from 0.0002 to 0.0030%

B is an element for improving hot workability of steel, and significantly improves drawing in a high temperature range of hot working. Accordingly, B is contained as needed. Although a mechanism by which B improves hot workability is not clear, it is said that segregation at grain boundaries increases grain boundary strength. Since the effect of improving hot tensile due to addition of B is exhibited at 0.0002% or more of B, the lower limit of B, if contained, is defined as 0.0002%. On the other hand, the upper limit of the B content is defined as 0.0030%, preferably 0.0015% since excessive B addition promotes solidification crack.

Sn: 0.05% or less

Zn+Pb+Bi: 0.0010% or less

Zr: 0.5% or less

Hf: 0.5% or less

La+Ce+Nd: 0.0050% or less

Sn is an element for improving corrosion resistance and high-temperature creep strength of steel, and may be added as needed. However, since addition of more than 0.05% lowers hot workability, the upper limit of a Sn content is defined as 0.05%. Moreover, since Pb, Zn, and Bi also significantly deteriorate hot workability of an austenite single-phase alloy, the upper limit of Pb, Zn, and Bi needs to be strictly defined, and a total content of Pb, Zn, and Bi is defined as 0.0010% or less.

Both Zr and Hf improve solidification cracking susceptibility and high-temperature oxidation resistance of steel by fixing P and S, and may be added as needed. On the other hand, a lot of addition of Zr and Hf exceeding 0.5% lowers productivity (e.g., hot workability) and surface texture. Accordingly, the upper limit of each of Zr and Hf contents is defined as 0.5%.

All of La, Ce, and Nd are elements for improving oxidation resistance and solidification cracking susceptibility by fixing P and S, whereas addition exceeding 0.0050% in total accelerates an increase of TiC precipitates and increases the liquefaction cracking susceptibility of steel. Accordingly, the upper limit of a total of La, Ce, and Nd contents is defined as 0.0050%. Examples of methods of adding these elements include adding in a form of each metal, adding in a form of an alloy of each metal, and adding in a form of misch metal.

W: 3% or less

W, similar to Mo, is an element for increasing strength of heat-resistant alloys, and may be added as needed. For the purpose of improving heat resistance in the steel of the invention, the upper limit of a W content is 3%.

V: from 0.01 to 0.5%, Nb: from 0.002 to 1.0%, Ta: from 0.002 to 1.0%

V, Nb, and Ta are described. All of V, Nb, and Ta may be added as needed, and improve high-temperature properties of alloys. The upper limit of each of Nb and Ta contents is defined as 1.0% in order to make the contents commensurate with costs. The upper limit of each of Nb and Ta contents is preferably 0.8%. The upper limit of the V content is defined as 0.5%. If added, the lower limit of the V content is 0.01% and the lower limit of each of the Nb and Ta is 0.002%. The lower limit of each of V, Nb, and Ta contents is preferably 0.03%. Each of V, Nb, and Ta contents preferably ranges from 0.03% to 0.8%.

The high Ni alloy of the invention is preferably used in a welded structure. This is because the weld hot cracking susceptibility, especially the HAZ cracking susceptibility, can be stabilized at a low level when manufacturing a structure by welding.

EXAMPLES

Example 1

Example of the first aspect of the invention is described below. The inventors melted a high Ni alloy in an MgO crucible of a 50-kg vacuum melting furnace, added Al, Ti, Ca, and Mg into the crucible, and cast the mixture into a 17-kg flat mold to obtain high Ni alloys with compositions shown in Tables 1 and 2. In this melting, flux was input in order to simulate a slag composition for secondary refining. Five types of powder reagents CaO, MgO, $Al_2O_3$, $SiO_2$, and $CaF_2$ were used as flux materials, and were mixed on the day of melting. Mixing conditions were, in mass % in the flux, MgO: 7.5%, $CaF_2$: 20%, mass ratios calculated from input amounts of CaO, $SiO_2$, $Al_2O_3$, and/or MgO: $CaO/Al_2O_3=0.91$, $Al_2O_3/MgO=3.7$, $CaO/SiO_2=1.3$, and the input amounts were set so that the amount of the flux in the crucible was 340 g. The flux was added two minutes after Ti and Al were added, and a Ca alloy was added 10 minutes after the flux was added. Steel tapping (start of casting into a mold) was performed for A1 to A11 and B6 to B8 at a timing of 7.5 minutes after the Ca alloy was added, and for B1 to B5 at a timing of 2.5 minutes after the Ca alloy was added. It should be noted that the balance of the components listed in Tables 1 and 2 is Fe and impurity elements, and all the units are mass %. Tables 1 and 2 indicate that the components in blank are in an impurity level.

TABLE 1

| Steel | Component Content (mass %) | | | | | | | | | | | | | | | | |
|---|---|---|---|---|---|---|---|---|---|---|---|---|---|---|---|---|---|
| No. | C | Si | Mn | P | S | Cr | Ni | Al | Ti | N | O | Mo | Cu | Go | Ca | Mg | Remarks |
| A1 | 0.074 | 0.41 | 1.15 | 0.025 | 0.0004 | 19.81 | 30.72 | 0.46 | 0.48 | 0.0092 | 0.0024 | | | | 0.0031 | 0.0007 | Examples of |
| A2 | 0.071 | 0.44 | 1.22 | 0.023 | 0.0004 | 19.92 | 30,51 | 0.38 | 0.38 | 0.0089 | 0.0022 | 0.18 | 0.12 | 0.11 | 0.0022 | 0.0011 | Invention |
| A3 | 0.075 | 0.48 | 1.16 | 0.022 | 0.0005 | 19.98 | 30.88 | 0.35 | 0.38 | 0.0083 | 0.0016 | 0.12 | 0.12 | 0.25 | 0.0018 | 0.0013 | |
| A4 | 0.073 | 0.42 | 1.18 | 0.017 | 0.0004 | 19,91 | 30.69 | 0.33 | 0.50 | 0.0081 | 0.0018 | 0.09 | 0.11 | 0.20 | 0.0019 | 0.0017 | |
| A5 | 0.031 | 0.21 | 1.12 | 0.024 | 0.0006 | 19.84 | 30,60 | 0.47 | 0.47 | 0.0094 | 0.0021 | 0.25 | 0.08 | 0.21 | 0.0049 | 0.0012 | |
| A6 | 0.076 | 0.41 | 0.37 | 0.025 | 0.0008 | 20.81 | 32.70 | 0.46 | 0.49 | 0.0095 | 0.0023 | 0.25 | 0.14 | 0.21 | 0.0030 | 0.0019 | |
| A7 | 0.074 | 0.40 | 1.15 | 0.018 | 0.0007 | 19.90 | 30.68 | 0.45 | 0.47 | 0.0104 | 0.0015 | 0.27 | 0.14 | 0.21 | 0.0035 | 0.0020 | |
| A8 | 0.013 | 0.35 | 0.52 | 0.019 | 0.0007 | 17.01 | 39.08 | 0.28 | 0.21 | 0.0072 | 0.0009 | 2.11 | 0.23 | 0,25 | 0.0039 | 0.0014 | |
| A9 | 0.018 | 0.39 | 1.07 | 0.020 | 0.0005 | 20.22 | 30.71 | 0.08 | 0.08 | 0.1030 | 0.0012 | 0.21 | 1.15 | 0.11 | 0.0011 | 0.0016 | |
| A10 | 0.070 | 0.42 | 1.15 | 0.021 | 0.0004 | 20.51 | 31.05 | 0.43 | 0.46 | 0.0069 | 0.0014 | 0.22 | 0.11 | 2.21 | 0.0019 | 0.0022 | |
| A11 | 0.073 | 0.46 | 1.13 | 0.023 | 0.0001 | 19.98 | 30.25 | 0.47 | 0.48 | 0.0073 | 0.0010 | 0.18 | 0.09 | 0.35 | 0.0020 | 0.0028 | |
| B1 | 0.070 | 0.41 | 1.15 | 0.025 | 0.0006 | 19.79 | 30.67 | 0.46 | 0.49 | 0.0086 | 0.0011 | 0.25 | 0.14 | 0.21 | 0.0028 | 0.0027 | Comparatives |
| B2 | 0.072 | 0.41 | 1.15 | 0.024 | 0.0005 | 19.86 | 30.72 | 0.46 | 0.49 | 0.0129 | 0.0011 | 0.25 | 0.14 | 0.21 | 0.0033 | 0.0036 | |
| B3 | 0.087 | 0.41 | 0.32 | 0.026 | 0.0005 | 19.97 | 30.60 | 0.26 | 0.44 | 0.0068 | 0.0030 | 0.24 | 0.14 | 0.20 | 0.0019 | 0.0007 | |
| B4 | 0.083 | 0.40 | 1.16 | 0.025 | 0.0007 | 19.96 | 30.65 | 0.34 | 0.46 | 0.0074 | 0.0023 | 0.24 | 0.15 | 0.20 | 0.0022 | 0.0014 | |
| B5 | 0.081 | 0.21 | 1.16 | 0.026 | 0.0006 | 19.97 | 30.68 | 0.40 | 0.47 | 0.0076 | 0.0019 | 0.24 | 0.14 | 0.21 | 0.0017 | 0.0023 | |
| B6 | 0.097 | 0.40 | 1.13 | 0.026 | 0.0004 | 19.98 | 30.72 | 0.27 | 0.45 | 0.0070 | 0.0018 | 0.24 | 0.12 | 0.21 | 0.0072 | 0.0021 | |
| B7 | 0.086 | 0.41 | 1.15 | 0.027 | 0.0005 | 19.84 | 30.71 | 1.35 | 0.50 | 0.0066 | 0.0007 | 0.24 | 0.14 | 0.20 | 0.0033 | 0.0032 | |
| B8 | 0.086 | 0.41 | 1.15 | 0.027 | 0.0006 | 19.84 | 30.71 | 0.37 | 1.53 | 0.0066 | 0.0011 | 0.24 | 0.14 | 0.20 | 0.0025 | 0.0033 | |

TABLE 2

| Steel | Component Content (mass %) | | | | | | | | | | | | | |
|---|---|---|---|---|---|---|---|---|---|---|---|---|---|---|
| No. | B | Sn | Zn | Pb | Bi | Zn + Pb + Bi | Zr | Hf | La + Ce + Nd | W | V | Nb | Ta | Remarks |
| A1 | | | | | | | | | | | | | | Examples of |
| A2 | 0.0002 | | 0.0001 | 0.0001 | 0.0001 | 0.0003 | | | 0.0011 | | | | | Invention |
| A3 | 0.0004 | 0.003 | | | | | | 0.08 | | | | | | |
| A4 | 0.0005 | | | | | | 0.09 | | | | | | | |
| A5 | 0.0008 | | | | | | | | | 0.37 | 0.10 | | | |
| A6 | 0.0003 | | 0.0001 | 0.0001 | 0.0001 | 0.0003 | | | | | 0.04 | 0.32 | | |
| A7 | 0.0003 | 0.014 | | | | | | | | | 0.10 | | 0.23 | |
| AB | 0.0003 | | | | | | 0.12 | | | | 0.09 | | | |
| A9 | 0.0005 | | | | | | | | 0.0012 | | 0.05 | | | |
| A10 | 0.0012 | | | | | | | 0.11 | | | 0.11 | | | |
| A11 | 0.0005 | | | | | | | | | | 0.04 | | | |
| B1 | | | | | | | | | | | 0.10 | | | Comparatives |
| B2 | | | 0.0001 | 0.0003 | | 0.0004 | | | | | 0.10 | | | |
| B3 | | 0.013 | | | | | | | | | 0.09 | | | |
| B4 | 0.0010 | 0.012 | | | | | | | | | 0.10 | | | |
| B5 | 0.0009 | | | | | | | | | | 0.11 | | | |
| B6 | 0.0010 | | | | | | | | | | 0.07 | | | |
| B7 | | | | | | | | | | | 0.10 | | | |
| B8 | | | | | | | | | | | 0.10 | | | |

A cast piece obtained from molten metal had dimensions of 48 mm thick×170 mm wide×225 mm high. This cast piece was subjected to the following treatments to prepare Longi-Varestraint test piece for evaluating HAZ cracking susceptibility. First, a surface of the cast piece was ground by 2 mm to remove defects thereon, and then the cast piece was cut into a shape of 44 mm thick×85 mm wide×170 mm long. The cut piece was heated for one hour at 1180 degrees C. and hot-rolled to have a thickness of 12.5 mm. Next, this thick plate was heat-treated at 1165 degrees C. for 10 minutes, double-sided ground to have a thickness of 12 mm, and cut into a test piece having a width of 40 mm and a length of 300 mm.

In the Longi-Varestraint test, TIG welding without a filler rod was performed in a longitudinal direction at the center of the width of the test piece under conditions of a welding current of 200 A, a voltage of 12 V, and a rate of 15 cm/min. In the middle of welding, bending stress was instantaneously applied in parallel to the welding direction so that 2% strain was applied to a top layer of the test piece. A portion where a weld crack occurred due to the application of bending stress was cut into a size observable with an optical microscope. After the cutout, a scale on a surface of a welded portion of the cut portion was removed by buffing, and existence/absence and degree of HAZ cracks were observed with the optical microscope. A length of each of HAZ cracks propagating from a boundary between weld metal and the base metal in the direction perpendicular to the welding direction was measured, and a sum of these lengths was defined as a total crack length. The test was conducted on two test pieces (n=2) prepared from a steel product represented by each steel number. When the average value of the total crack lengths of the two test pieces (n=2) was 1 mm or less, the steel product was judged favorable. When the average value exceeded 1 mm, the steel product was judged unsuitable. When the average value was 0.4 mm or less, the steel product was judged to excellent.

Inclusions were measured according to FE-SEM-EDS analysis. SU5000 manufactured by Hitachi High-Technology Co., Ltd. was used as FE-SEM, and EMAX Evolution was used as analysis software. A cutout in a size of 25 mm×25 mm was obtained from a non-thermally affected portion of the Longi-Varestraint test piece and filled with resin so that a top layer of the cutout served as an observation surface. Subsequently, in order to prevent precipitates such as oxides, sulfides, nitrides, and carbides on the top layer from dissolving, mirror polishing was performed with diamond abrasive grains. A measurement area was limited to 2.5 $mm^2$ or less. Among particles recognized as particles by the analysis software from contrast information of a back-scattered electron image, particles with equivalent circle diameters of 1.0 μm or more converted from the area were automatically quantitatively analyzed by EDX. A measurement time was 0.5 seconds per particle. Among the detected particles, particles in which Ti and C were detected but N was not detected were extracted as TiC particles, and the number of the detected particles was divided by the measurement area to obtain the number density. Table 3 shows examination results of the number density of the TiC precipitates and measurement results of the total HAZ crack length (average with n=2). FIG. 1 shows a relationship between HAZ cracking susceptibility, the TiC number density, and the Mg content. In FIG. 1, the test pieces each having a total HAZ crack length of 1 mm or less are shown as favorable (denoted by white circles), and the rest of the test pieces are shown as poor (denoted by black squares). A solid line shown in FIG. 1 indicates as follows:

number density of TiC (number of pieces/$mm^2$)=463−9.5×Mg concentration in steel (mass ppm).

In Table 3, a value of "number density of TiC (number of pieces/$mm^2$)+9.5×Mg concentration in steel (mass ppm)" is denoted by X.

TABLE 3

| Steel No. | TiC Number Density (≥1 μm, pieces/$mm^2$) | X(*) | Total HAZ Crack Length (mm) | Remarks |
|---|---|---|---|---|
| A1 | 358 | 424.5 | 0.59 | Examples of Invention |
| A2 | 312 | 416.5 | 0.47 | |
| A3 | 273 | 396.5 | 0.41 | |
| A4 | 285 | 446.5 | 0.67 | |
| A5 | 219 | 333 | 0.48 | |
| A6 | 219 | 399.5 | 0.30 | |
| A7 | 115 | 305 | 0.35 | |
| A8 | 172 | 305 | 0.63 | |
| A9 | 107 | 259 | 0.42 | |
| A10 | 153 | 362 | 0.51 | |
| A11 | 172 | 438 | 0.51 | |
| B1 | 244 | 500.5 | 2.35 | Comparatives |
| B2 | 142 | 484 | 2.05 | |
| B3 | 402 | 468.5 | 2.09 | |
| B4 | 382 | 515 | 2.63 | |
| B5 | 330 | 548.5 | 3.41 | |
| B6 | 287 | 486.5 | 2.97 | |
| B7 | 336 | 640 | 3.09 | |
| B8 | 412 | 725.5 | 3.09 | |

(*)X: TiC Number Density (number of pieces/$mm^2$) + 9.5 × Mg concentration in steel (mass ppm)
At X ≤ 463, HAZ cracking susceptibility is favorable.

According to Examples in Table 3 and FIG. 1, in Steel Nos. A1 to A11 of the invention, in which the value of "X=number density of TiC (number of pieces/$mm^2$)+9.5×Mg concentration in steel (mass ppm)" was equal to or less than 463, a value of the total HAZ crack length generated in a weld hot crack test was favorable as being equal to or less than 1 mm on average with n=2.

Steel Nos. B1 to B8 are Comparatives. Among Steel Nos. B1 to B5, in which the time from Ca addition to tapping was shortened, Steel Nos. B1, B2, and B5 had high Mg concentrations in the steel, and Steel Nos. B3 and B4 had high oxygen concentrations in the steel, resulting in high TiC number density. Steel Nos. B6 to B8, in which a deoxidization reinforcing element Ca, Ti or Al was excessively added, exhibited a high Mg concentration or a high TiC number density in the steel. Therefore, all of Steel Nos. B1 to B8 showed a value of X greater than 463 in Table 3, that is, did not satisfy the formula (1), and the value of the total HAZ crack length significantly exceeded 1 mm. It is obvious that Comparative Steel Nos. B1 to B8, which do not satisfy the requirements of the invention, have a sharp increase in HAZ cracking susceptibility.

As can be seen from the above Example, it has become clear that the first aspect of the invention can produce a high Ni alloy with a low weld hot cracking susceptibility.

Example 2

Example of the second aspect of the invention will be described below. The inventors melted a high Ni alloy in a MgO crucible with a 50-kg vacuum melting furnace, added Al, Ti, Ca, and Mg into the crucible, and cast the mixture into a 17-kg flat mold to obtain high Ni alloys with compositions shown in Tables 4 and 5. In this melting, flux was input in order to simulate a slag composition for secondary refining. Five types of powder reagents CaO, MgO, $Al_2O_3$, $SiO_2$, and $CaF_2$ were used as flux materials, and were prepared on the day of melting. Mixing conditions were, in mass % in the flux, MgO: 7.5%, $CaF_2$: 20%, flux mass ratios calculated from input amounts of CaO, $SiO_2$, $Al_2O_3$, and/or MgO: $CaO/Al_2O_3=2.5$ ($(CaO+CaF_2)/Al_2O_3=3.5$), $Al_2O_3/MgO=2.7$, and $CaO/SiO_2=20$, and the input amounts were set so that the amount of flux in the crucible was 340 g. The flux was added two minutes after Ti and Al were added, and a Ca alloy was added 10 minutes after the flux was added. Steel tapping (start of casting into a mold) was performed for Steel Nos. A1 to A11 and B4 at a timing of 7.5 minutes after the Ca alloy was added, and for B1 to B3 and B5 to B7 at a timing of 2.5 minutes after the Ca alloy was added. It should be noted that the balance of the components listed in Tables 4 and 5 is Fe and impurity elements, and all the units are mass %. Tables 4 and 5 indicate that the components in blank are in an impurity level.

TABLE 4

| Steel | Component Content (mass %) | | | | | | | | | |
|---|---|---|---|---|---|---|---|---|---|---|
| No | C | Si | Mn | P | S | O | O + S | Cr | Ni | Al |
| A1 | 0.078 | 0.39 | 1.13 | 0.026 | 0.0006 | 0.0009 | 0.0015 | 19.91 | 30.55 | 0.44 |
| A2 | 0.058 | 0.41 | 1.18 | 0.023 | 0.0002 | 0.0011 | 0.0013 | 19.89 | 30.72 | 0.35 |
| A3 | 0.065 | 0.43 | 1.25 | 0.018 | 0.0003 | 0.0013 | 0.0016 | 20.03 | 30.46 | 0.35 |
| A4 | 0.071 | 0.37 | 1.07 | 0.020 | 0.0001 | 0.0015 | 0.0016 | 19.95 | 30.57 | 0.37 |
| A5 | 0.072 | 0.48 | 1.14 | 0.025 | 0.0005 | 0.0014 | 0.0019 | 18.07 | 30.48 | 0.47 |
| A6 | 0.070 | 0.43 | 1.12 | 0.023 | 0.0001 | 0.0012 | 0.0013 | 19.25 | 30.52 | 0.43 |
| A7 | 0.073 | 0.55 | 1.23 | 0.022 | 0.0002 | 0.0013 | 0.0015 | 19.49 | 32.15 | 0.49 |
| A8 | 0.027 | 1.13 | 0.35 | 0.017 | 0.0001 | 0.0009 | 0.0010 | 20.05 | 37.17 | 0.52 |
| A9 | 0.065 | 0.37 | 1.08 | 0.020 | 0.0001 | 0.0012 | 0.0013 | 24.17 | 38.00 | 0.31 |
| A10 | 0.047 | 0.32 | 1.12 | 0.017 | 0.0001 | 0.0013 | 0.0014 | 20.03 | 30.51 | 0.12 |
| A11 | 0.013 | 0.41 | 1.05 | 0.019 | 0.0002 | 0.0011 | 0.0013 | 20.59 | 35.12 | 0.33 |
| B1 | 0.071 | 0.43 | 1.16 | 0.025 | 0.0006 | 0.0015 | 0.0021 | 19.79 | 30.32 | 0.46 |
| B2 | 0.073 | 0.41 | 1.18 | 0.022 | 0.0003 | 0.0019 | 0.0022 | 19.86 | 30.26 | 0.46 |
| B3 | 0.077 | 0.38 | 1.15 | 0.023 | 0.0005 | 0.0021 | 0.0026 | 19.97 | 30.31 | 0.26 |
| B4 | 0.073 | 0.38 | 1.08 | 0.020 | 0.0007 | 0.0015 | 0.0022 | 20.02 | 30.38 | 0.63 |
| B5 | 0.073 | 0.41 | 1.15 | 0.025 | 0.0001 | 0.0011 | 0.0012 | 20.53 | 30.51 | 0.51 |
| B6 | 0.085 | 0.35 | 1.19 | 0.022 | 0.0002 | 0.0013 | 0.0015 | 18.83 | 38.15 | 0.52 |
| B7 | 0.082 | 0.33 | 1.19 | 0.024 | 0.0001 | 0.0017 | 0.0018 | 18.82 | 39.91 | 1.28 |

| Steel No | Component Content (mass %) | | | | | | | Remarks |
|---|---|---|---|---|---|---|---|---|
| | Ti | N | Mo | Cu | Co | Ca | Mg | |
| A1 | 0.27 | 0.011 | | | | 0.0016 | 0.0018 | Examples of Invention |
| A2 | 0.37 | 0.010 | 0.15 | 0.11 | 0.29 | 0.0018 | 0.0014 | |
| A3 | 0.36 | 0.009 | 0.23 | 0.09 | 0.35 | 0.0021 | 0.0019 | |
| A4 | 0.37 | 0.008 | 0.19 | 0.13 | 0.39 | 0.0017 | 0.0020 | |
| A5 | 0.51 | 0.008 | 0.38 | 0.18 | 0.32 | 0.0018 | 0.0030 | |
| A6 | 0.42 | 0.008 | | | | 0.0022 | 0.0022 | |
| A7 | 0.35 | 0.007 | 0.07 | 0.05 | 0.38 | 0.0037 | 0.0018 | |
| A8 | 0.31 | 0.006 | 0.25 | 0.12 | 0.41 | 0.0025 | 0.0023 | |
| A9 | 0.48 | 0.007 | 0.87 | 0.08 | 0.29 | 0.0047 | 0.0027 | |
| A10 | 0.06 | 0.017 | 1.15 | 1.05 | 0.32 | 0.0028 | 0.0021 | |
| A11 | 0.13 | 0.006 | 0.22 | 0.08 | 0.27 | 0.0036 | 0.0017 | |
| B1 | 0.49 | 0.009 | 0.21 | 0.14 | 0.21 | 0.0028 | 0.0027 | Comparatives |
| B2 | 0.49 | 0.013 | 0.17 | 0.14 | 0.21 | 0.0033 | 0.0046 | |
| B3 | 0.44 | 0.007 | 0.14 | 0.14 | 0.20 | 0.0019 | 0.0025 | |
| B4 | 0.53 | 0.006 | 0.13 | 0.12 | 0.20 | 0.0008 | 0.0022 | |
| B5 | 0.42 | 0.008 | 0.21 | 0.14 | 0.25 | 0.0055 | 0.0058 | |
| B6 | 1.53 | 0.007 | 0.20 | 0.14 | 0.33 | 0.0031 | 0.0063 | |
| B7 | 0.48 | 0.008 | 0.20 | 0.13 | 0.28 | 0.0038 | 0.0061 | |

TABLE 5

| Steel | Component Content (mass %) | | | | | | | | | | | | | |
|---|---|---|---|---|---|---|---|---|---|---|---|---|---|---|
| No. | B | Sn | Zn | Pb | Bi | Zn + Pb + Bi | Zr | Hf | La + Ce + Nd | W | V | Nb | Ta | Remarks |
| A1 | | | | | | | | | | | 0.10 | | | Examples of Invention |
| A2 | 0.0003 | | | | | | 0.12 | 0.06 | | | | | | |
| A3 | | | | | | | | | 0.0011 | | | | | |
| A4 | 0.0005 | 0.003 | 0.0001 | 0.0001 | 0.0001 | 0.0003 | | | | | | | | |
| A5 | 0.0003 | | | | | | | | | 0.35 | 0.10 | | | |
| A6 | | | | | | | | | | | | | | |
| A7 | 0.0012 | | 0.0001 | 0.0001 | 0.0001 | 0.0003 | 0.11 | | | | 0.05 | | 0.10 | |
| A8 | 0.0005 | 0.008 | | | | | | 0.05 | | | 0.04 | | | |
| A9 | 0.0003 | | | | | | | | 0.0017 | | 0.08 | | | |
| A10 | | | 0.0002 | 0.0001 | | 0.0003 | | | | | 0.04 | | | |
| A11 | 0.0004 | | | | | | | | | | 0.05 | 0.31 | | |

TABLE 5-continued

| Steel | Component Content (mass %) | | | | | | | | | | | | | |
|---|---|---|---|---|---|---|---|---|---|---|---|---|---|---|
| No. | B | Sn | Zn | Pb | Bi | Zn + Pb + Bi | Zr | Hf | La + Ce + Nd | W | V | Nb | Ta | Remarks |
| B1 | 0.0002 | | 0.0001 | 0.0001 | | 0.0003 | | | 0.0013 | | 0.10 | | | Comparatives |
| B2 | 0.0008 | | 0.0002 | 0.0001 | 0.0001 | 0.0004 | | | | | 0.10 | | | |
| B3 | | 0.013 | | | | | | | | | 0.10 | | | |
| B4 | | | | | | | | | | | 0.07 | | | |
| B5 | 0.0005 | | | | | | | | | | 0.06 | | | |
| B6 | | | | | | | | | | | 0.09 | | | |
| B7 | | | | | | | | | | | 0.08 | | | |

A cast piece obtained from molten metal had dimensions of 48 mm thick×170 mm wide×225 mm high. This cast piece was subjected to the following treatments to prepare Longi-Varestraint test piece for evaluating HAZ cracking susceptibility. First, a surface of the cast piece was ground by 2 mm to remove defects thereon, and then cut into a shape of 44 mm thick×85 mm wide×170 mm long. The cut piece was heated for one hour at 1180 degrees C. and hot-rolled to have a thickness of 12.5 mm. Next, this thick plate was heat-treated at 1165 degrees C. for 10 minutes, double-sided ground to have a thickness of 12 mm, and cut into a test piece having a width of 40 mm and a length of 300 mm.

In the Longi-Varestraint test, TIG welding without a filler rod was performed in a longitudinal direction at the center of the width of the test piece under conditions of a welding current of 200 A, a voltage of 12V, and a rate of 15 cm/min. In the middle of welding, bending stress was instantaneously applied in parallel to the welding direction so that 2% strain was applied to a top layer of the test piece. A portion where a weld crack occurred due to the application of bending stress was cut into a size observable with an optical microscope. After the cutout, a scale on a surface of a welded portion was removed by buffing, and existence/absence and degree of HAZ cracks were observed with the optical microscope. A length of each of HAZ cracks propagating from a boundary between weld metal and a base metal in the direction perpendicular to the welding direction was measured, and a sum of these lengths was defined as a total crack length. The test was conducted on two test pieces (n=2) prepared from a steel product represented by each steel number. When the average value of the total crack lengths of the two test pieces (n=2) was 1 mm or less, the steel product was judged favorable. When the average value exceeded 1 mm, the steel product was judged unsuitable. When the average value was 0.4 mm or less, the steel product was judged to excellent.

Inclusions were measured according to FE-SEM-EDS analysis. SU5000 manufactured by Hitachi High-Technology Co., Ltd. was used as FE-SEM, and EMAX Evolution was used as analysis software. A cutout in a size of 25 mm×25 mm was obtained from a non-thermally affected portion of the Longi-Varestraint test piece and filled with resin so that a top layer of the cutout served as an observation surface. Subsequently, in order to prevent precipitates such as oxides, sulfides, nitrides, and carbides on the top layer from dissolving, mirror polishing was performed with diamond abrasive grains. A measurement area was limited to 2.5 $mm^2$ or less. Among particles recognized as particles by the analysis software from contrast information of a back-scattered electron image, particles with equivalent circle diameters of 0.6 μm or more converted from the area were automatically quantitatively analyzed by EDX. A measurement time was 0.5 seconds per particle. Among the detected particles, particles in which 0 or S was detected were extracted as inclusion particles, and an average content of each element was calculated as follows.

Average content of each component (mass %)=Σ (analysis value of each particle (mass %)×surface area ($mm^2$))/(number of particles×average surface area ($mm^2$))

Figure 2:
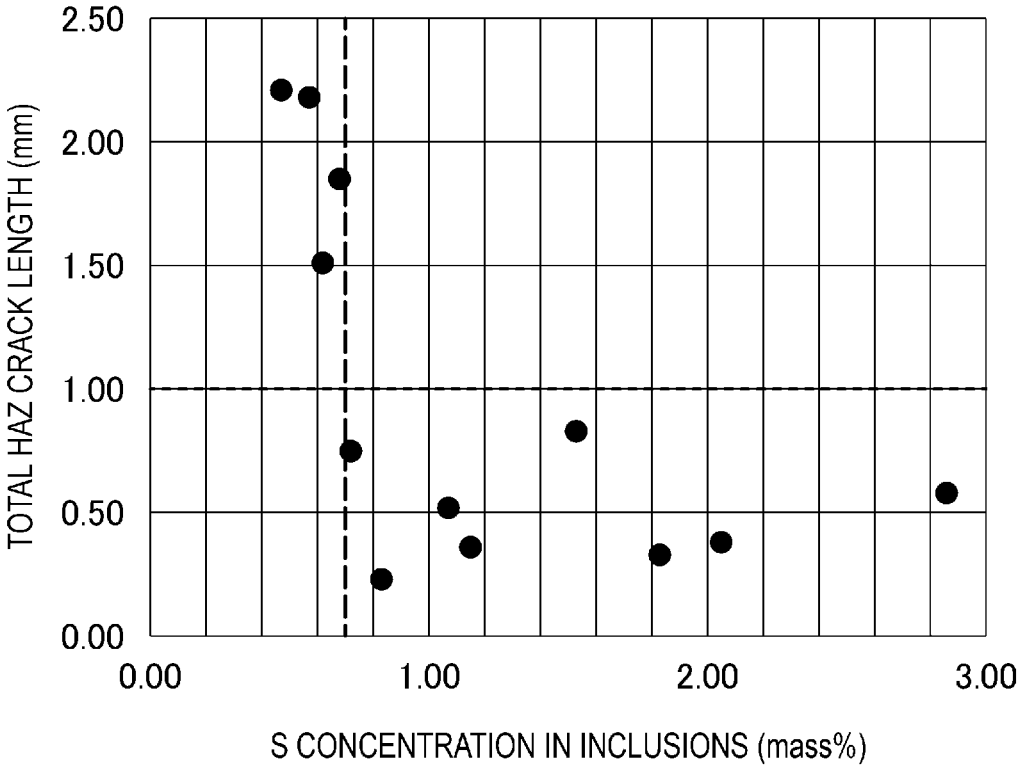
FIG. 2 illustrates a relationship between an average content of sulfur in oxide inclusions and sulfide inclusions and a total length of HAZ cracks in the inventive steel and comparative steel.

Table 6 shows the S concentration in inclusions obtained by this method and the measurement results of the total HAZ crack length. FIG. 2 shows a relationship between the total HAZ crack length and the S concentration in the inclusions.

TABLE 6

| Steel No. | S Average Concentration in Inclusions (mass %) | Total HAZ Crack Length (mm) | Remarks |
|---|---|---|---|
| A1 | 1.15 | 0.36 | Examples of Invention |
| A2 | 0.95 | 0.73 | |
| A3 | 0.88 | 0.81 | |
| A4 | 1.38 | 0.71 | |
| A5 | 0.83 | 0.23 | |
| A6 | 0.72 | 0.75 | |
| A7 | 1.53 | 0.83 | |
| A8 | 1.07 | 0.52 | |
| A9 | 2.86 | 0.58 | |
| A10 | 1.83 | 0.33 | |
| A11 | 2.05 | 0.38 | |
| B1 | 0.57 | 2.18 | Comparatives |
| B2 | 0.68 | 1.85 | |
| B3 | 0.47 | 2.21 | |
| B4 | 0.62 | 1.51 | |
| B5 | 1.35 | 2.05 | |
| B6 | 1.15 | 2.29 | |
| B7 | 1.38 | 2.89 | |

According to Examples in Table 6 and FIG. 2, in Steel Nos. A1 to A11, in which the value of the average concentration of S in the inclusions is equal to or more than 0.70 mass %, the value of the total HAZ crack length generated in the weld hot crack test was favorable as being equal to or less than 1 mm on average with n=2.

In contrast, for Steel Nos. B1 to B4 showing that the average concentration of S in the inclusions was smaller than 0.70 mass %, the value of the total HAZ crack length significantly exceeded 1 mm, revealing that HAZ cracking susceptibility increased sharply. For Steel Nos. B1 to B4, a value of O+S exceeded 20 ppm and the S concentration in the inclusions did not satisfy S≥0.70 mass %. For Steel No. B3, a value of 0 alone exceeded 20 ppm. In Steel No. B4 unlike Steel Nos. B1 to B3, the time from Ca input to tapping was the same as in Steel Nos. A1 to A7. However, since the Ca alloy was input under the condition that the Ca target value was less than 0.010%, the S concentration in the inclusions was 0.70% or less, and the HAZ cracking susceptibility also did not reach the level of the steel of the invention. For Steel Nos. B5 to B7, although the value of O+S was less than 20 ppm, the Mg content exceeded 50 ppm. Ca was excessively added to Steel No. B5 and exceeded the upper limit of the second aspect of the invention. Deoxidization reinforcing elements Al and Ti in Steel No. B6 exceeded the upper limit of the second aspect of the invention. It is assumed that this accelerated the Mg pick-up during Ca addition, and as a result, the HAZ cracking susceptibility increased.

As can be seen from the above Example, it has become clear that the second aspect of the invention can produce a high Ni alloy with a low weld hot cracking susceptibility.

Example 3

Example of the third aspect of the invention will be described below. The inventors melted a high Ni alloy in a MgO crucible of a 50 kg-vacuum melting furnace, added Al, Ti, Ca, and Mg into the crucible, and cast the mixture into a 17-kg flat mold to obtain high Ni alloys with compositions shown in Tables 7 and 8. In order to simulate the slag composition for the secondary refining in this melting, five kinds of powder reagents of CaO, MgO, $Al_2O_3$, $SiO_2$, and $CaF_2$ were mixed into a predetermined composition immediately before the melting, and were input so that the amount of flux in the crucible was 340 g, then to which the Ca alloy was input. The flux was added two minutes after Ti and Al were added, and the Ca alloy was added five minutes after the flux was added. Steel tapping (start of casting into a mold) was performed at a timing of 2.5 minutes after the Ca alloy was added. However, Steel No. B8 in Tables 7 and 8 was tapped 7.5 minutes after the addition of the flux without addition the Ca alloy. It should be noted that the balance of the components listed in Tables 7 and 8 is Fe and impurity elements, and all the units are mass %. Tables 7 and 8 indicate that the components in blank are in an impurity level.

TABLE 7

| Steel | Component Content (mass %) | | | | | | | | | | | | | | | | |
|---|---|---|---|---|---|---|---|---|---|---|---|---|---|---|---|---|---|
| No. | C | Si | Mn | P | S | Cr | Ni | Al | Ti | N | O | Mo | Cu | Co | Ca | Mg | Remarks |
| A1 | 0.070 | 0.72 | 1.10 | 0.021 | 0.0005 | 20.11 | 30.70 | 0.48 | 0.51 | 0.001 | 0.0010 | | | | 0.0020 | 0.0018 | Examples of |
| A2 | 0.071 | 0.71 | 1.14 | 0.026 | 0.0005 | 19.79 | 30.69 | 0.46 | 0.50 | 0.009 | 0.0010 | | | | 0.0019 | 0.0018 | Invention |
| A3 | 0.073 | 0.41 | 1.15 | 0.025 | 0.0005 | 19.78 | 30.88 | 0.47 | 0.49 | 0.011 | 0.0011 | 0.25 | 0.14 | 0.21 | 0.0025 | 0.0030 | |
| A4 | 0.013 | 0.35 | 0.52 | 0.019 | 0.0003 | 17.01 | 39.08 | 0.28 | 0.21 | 0.007 | 0.0013 | 5.11 | 0.23 | 0.25 | 0.0039 | 0.0014 | |
| A5 | 0.031 | 0.21 | 1.12 | 0.024 | 0.0006 | 19.84 | 30.60 | 0.47 | 0.47 | 0.009 | 0.0021 | 0.25 | 0.08 | 0.21 | 0.0049 | 0.0012 | |
| A6 | 0.074 | 0.40 | 1.15 | 0.018 | 0.0007 | 19.90 | 30.68 | 0.45 | 0.47 | 0.010 | 0.0015 | 0.27 | 0.14 | 0.21 | 0.0035 | 0.0020 | |
| A7 | 0.018 | 0.39 | 1.07 | 0.020 | 0.0002 | 20.22 | 30.71 | 0.51 | 0.31 | 0.007 | 0.0009 | 0.21 | 2.88 | 0.11 | 0.0011 | 0.0006 | |
| A8 | 0.076 | 0.41 | 0.37 | 0.025 | 0.0005 | 20.81 | 32.70 | 0.46 | 0.49 | 0.010 | 0.0013 | 0.25 | 0.14 | 0.21 | 0.0030 | 0.0019 | |
| A9 | 0.015 | 1.25 | 0.81 | 0.017 | 0.0002 | 16.28 | 40.05 | 0.08 | 0.72 | 0.007 | 0.0008 | 0.28 | 0.19 | 0.28 | 0.0035 | 0.0021 | |
| A10 | 0.068 | 0.36 | 1.18 | 0.024 | 0.0002 | 20.21 | 30.76 | 0.48 | 0.46 | 0.007 | 0.0009 | 0.24 | 0.15 | 0.45 | 0.0018 | 0.0033 | |
| A11 | 0.074 | 0.41 | 1.15 | 0.025 | 0.0004 | 19.81 | 30.72 | 0.46 | 0.48 | 0.009 | 0.0024 | 0.06 | 0.14 | 0.20 | 0.0031 | 0.0007 | |
| A12 | 0.070 | 0.42 | 1.15 | 0.021 | 0.0003 | 20.51 | 31.05 | 0.43 | 0.46 | 0.007 | 0.0014 | 0.22 | 0.11 | 2.21 | 0.0019 | 0.0012 | |
| A13 | 0.055 | 0.42 | 1.12 | 0.015 | 0.0002 | 25.88 | 35.99 | 0.08 | 0.06 | 0.221 | 0.0008 | 0.40 | 0.10 | 0.28 | 0.0024 | 0.0007 | |
| A14 | 0.068 | 0.38 | 1.18 | 0.022 | 0.0006 | 20.05 | 31.78 | 0.43 | 0.44 | 0.005 | 0.0015 | 0.23 | 0.13 | 0.40 | 0.0018 | 0.0019 | |
| B1 | 0.083 | 0.40 | 1.16 | 0.025 | 0.0007 | 19.96 | 30.65 | 0.34 | 0.46 | 0.007 | 0.0023 | 0.24 | 0.14 | 0.20 | 0.0022 | 0.0014 | Comparatives |
| B2 | 0.081 | 0.21 | 1.16 | 0.026 | 0.0006 | 19.97 | 30.68 | 0.40 | 0.47 | 0.008 | 0.0019 | 0.24 | 0.14 | 0.21 | 0.0017 | 0.0023 | |
| B3 | 0.070 | 0.41 | 1.15 | 0.025 | 0.0006 | 19.79 | 30.67 | 0.46 | 0.49 | 0.009 | 0.0011 | 0.25 | 0.14 | 0.21 | 0.0028 | 0.0027 | |
| B4 | 0.072 | 0.41 | 1.15 | 0.024 | 0.0005 | 19.86 | 30.72 | 0.46 | 0.49 | 0.013 | 0.0011 | 0.25 | 0.14 | 0.21 | 0.0033 | 0.0036 | |
| B5 | 0.087 | 0.41 | 0.32 | 0.026 | 0.0005 | 19.97 | 30.60 | 0.26 | 0.44 | 0.007 | 0.0033 | 0.24 | 0.14 | 0.20 | 0.0019 | 0.0007 | |
| B6 | 0.097 | 0.40 | 1.13 | 0.026 | 0.0003 | 19.98 | 30.72 | 0.27 | 0.45 | 0.007 | 0.0018 | 0.24 | 0.14 | 0.21 | 0.0014 | 0.0053 | |
| B7 | 0.086 | 0.41 | 1.15 | 0.027 | 0.0006 | 19.84 | 30.71 | 0.37 | 0.50 | 0.007 | 0.0011 | 0.24 | 0.14 | 0.20 | 0.0005 | 0.0048 | |
| B8 | 0.075 | 0.43 | 1.18 | 0.023 | 0.0009 | 20.02 | 30.55 | 0.44 | 0.50 | 0.007 | 0.0029 | 0.23 | 0.13 | 0.18 | 0.0002 | 0.0018 | |
| B9 | 0.083 | 0.22 | 1.22 | 0.022 | 0.0002 | 19.99 | 39.54 | 0.58 | 1.73 | 0.010 | 0.0008 | 0.22 | 0.15 | 0.35 | 0.0023 | 0.0058 | |
| B10 | 0.082 | 0.23 | 1.22 | 0.024 | 0.0004 | 20.03 | 40.03 | 1.35 | 0.48 | 0.008 | 0.0006 | 0.22 | 0.14 | 0.37 | 0.0028 | 0.0073 | |

TABLE 8

| Steel | Component Content (mass %) | | | | | | | | | | | | | |
|---|---|---|---|---|---|---|---|---|---|---|---|---|---|---|
| No. | B | Sn | Zn | Pb | Bi | Zn + Pb + Bi | Zr | Hf | La + Ce + Nd | W | V | Nb | Ta | Remarks |
| A1 | | | | | | | | | | | | | | Examples of Invention |
| A2 | 0.0005 | 0.003 | | | | | | | | | | | | |
| A3 | 0.0013 | 0.004 | 0.0001 | 0.0001 | 0.0001 | 0.0003 | | | | 0.22 | 0.10 | | | |
| A4 | 0.0003 | | | | | | | | | 2.05 | 0.09 | | | |
| A5 | 0.0008 | 0.012 | | | | | | | 0.0015 | | 0.10 | | | |
| A6 | 0.0003 | 0.014 | | | | | | | | | 0.10 | | 0.23 | |
| A7 | 0.0005 | 0.004 | | 0.0002 | | 0.0002 | 0.12 | | | | 0.08 | | | |
| A8 | 0.0003 | | | | | | | | | | 0.04 | 0.08 | | |
| A9 | | 0.002 | | | | | | | | | 0.10 | | | |
| A10 | 0.0004 | | | | | | | | | | 0.04 | | | |

TABLE 8-continued

| Steel | Component Content (mass %) | | | | | | | | | | | | | |
|---|---|---|---|---|---|---|---|---|---|---|---|---|---|---|
| No. | B | Sn | Zn | Pb | Bi | Zn + Pb + Bi | Zr | Hf | La + Ce + Nd | W | V | Nb | Ta | Remarks |
| A11 | | | 0.0001 | | 0.0001 | 0.0002 | | | | | | | | |
| A12 | | 0.002 | | | | | | 0.11 | | | 0.11 | | | |
| A13 | 0.0006 | 0.005 | | | | | | | | 0.16 | 0.08 | 0.35 | 0.07 | |
| A14 | | 0.000 | | | | | | | | | 0.06 | | | |
| B1 | 0.0010 | 0.012 | | | | | | | | | 0.10 | | | Comparatives |
| B2 | 0.0009 | 0.031 | | | | | | | | | 0.10 | | | |
| B3 | 0.0005 | | | 0.0003 | | 0.0003 | | | 0.0013 | | 0.10 | | | |
| B4 | 0.0003 | | 0.0003 | 0.0001 | | 0.0004 | | | | | 0.10 | | | |
| B5 | | 0.013 | | | | | | | | | 0.10 | | | |
| B6 | 0.0010 | 0.013 | | | | | | | | | 0.09 | | | |
| B7 | | 0.012 | | | | | | | | | 0.10 | | | |
| B8 | | | | | | | | | | | 0.11 | | | |
| B9 | | | | | | | | | | | 0.08 | | | |
| B10 | | | | | | | | | | | 0.07 | | | |

A cast piece obtained from molten metal had dimensions of 48 mm thick x 170 mm wide×225 mm high. This cast piece was subjected to the following treatments to prepare Longi-Varestraint test piece for evaluating HAZ cracking susceptibility. First, a surface of the cast piece was ground by 2 mm to remove defects thereon, and then the cast piece was cut into a shape of 44 mm thick×85 mm wide×170 mm long. The cut piece was heated for one hour at 1180 degrees C. and hot-rolled to have a thickness of 12.5 mm. Next, this thick plate was heat-treated at 1165 degrees C. for 10 minutes, double-sided ground to have a thickness of 12 mm, and cut into a test piece having a width of 40 mm and a length of 300 mm.

In the Longi-Varestraint test, TIG welding without a filler rod was performed in a longitudinal direction at the center of the width of the test piece under conditions of a welding current of 200 A, a voltage of 12V, and a rate of 15 cm/min. In the middle of welding, bending stress was instantaneously applied in parallel to the welding direction so that 2% strain was applied to a top layer of the test piece. A portion where a weld crack occurred due to the application of bending stress was cut into a size observable with an optical microscope. After the cutout, a scale on a surface of a welded portion was removed by buffing, and existence/absence and degree of HAZ cracks were observed with the optical microscope. A length of each of HAZ cracks propagating from a boundary between weld metal and a base metal in the direction perpendicular to the welding direction was measured, and a sum of these lengths was defined as a total crack length. The test was conducted on two test pieces (n=2) prepared from a steel product represented by each steel number. When the average value of the total crack lengths of the two test pieces (n=2) was 1 mm or less, the steel product was judged favorable. When the average value exceeded 1 mm, the steel product was judged unsuitable. When the average value was 0.4 mm or less, the steel product was judged to excellent.

Inclusions were measured according to FE-SEM-EDS analysis. SU5000 manufactured by Hitachi High-Technology Co., Ltd. was used as FE-SEM, and EMAX Evolution was used as analysis software. A cutout in a size of 25 mm×25 mm was obtained from a non-thermally affected portion of the Longi-Varestraint test piece and filled with resin so that a top layer of the cutout served as an observation surface. Subsequently, in order to prevent precipitates such as oxides, sulfides, nitrides, and carbides on the top layer from dissolving, mirror polishing was performed with diamond abrasive grains. A measurement area was limited to 2.5 $mm^2$ or less. Among particles recognized as particles by the analysis software from contrast information of a back-scattered electron image, particles with equivalent circle diameters of 0.6 μm or more converted from the area were automatically quantitatively analyzed by EDX. A measurement time was 0.5 seconds per particle. Among the detected particles, particles in which O or S was detected were extracted as inclusion particles, and an average content of each element was calculated as follows.

Average content of each component (mass %)=> (analysis value of each particle (mass %)×surface area ($mm^2$))/(number of particles×average surface area ($mm^2$))

Figure 3:
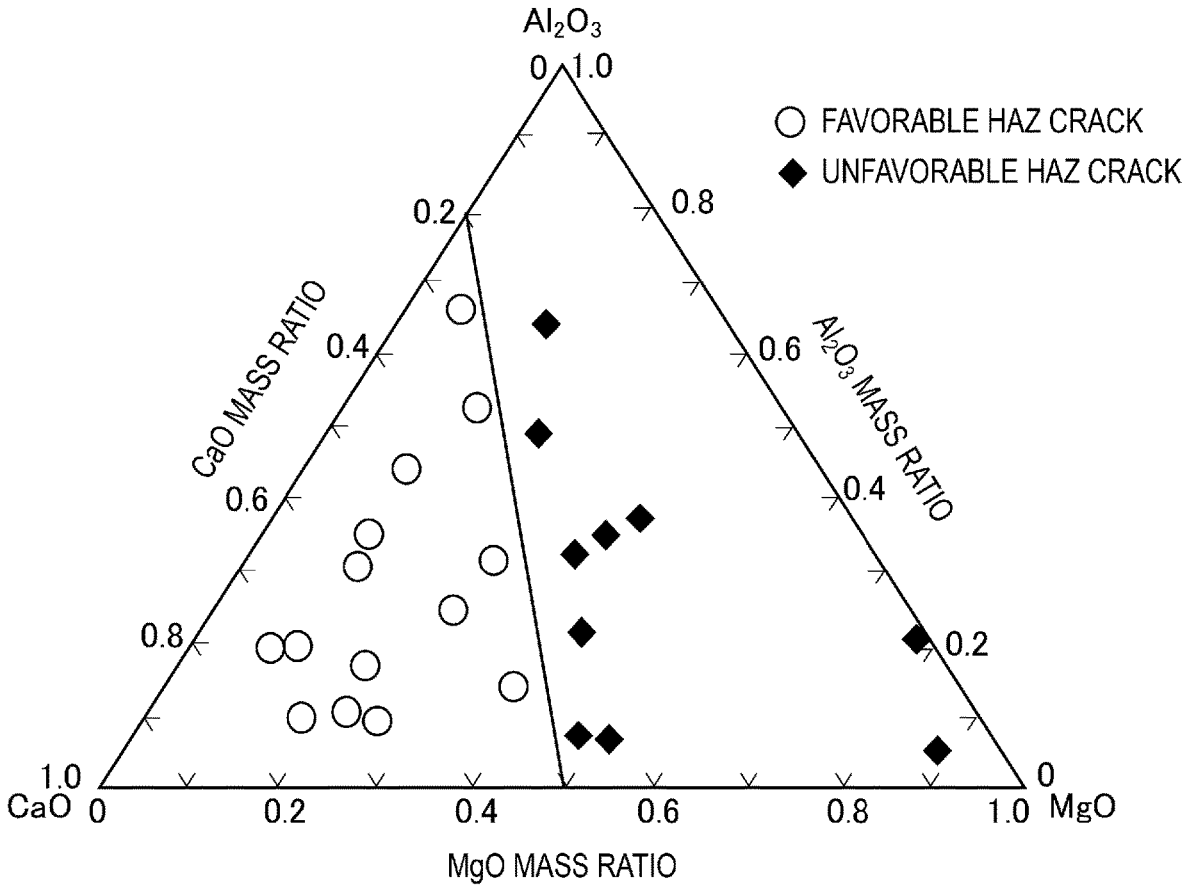
FIG. 3 is a CaO—MgO—$Al_2O_3$ ternary phase diagram showing a plotted average composition of inclusions.

Assuming that each of components Ca, Mg, and Al exists as an oxide in total amount, each of CaO, MgO, and $Al_2O_3$ in mass % was calculated by conversion from the average content of the corresponding one of Ca, Mg, and Al. A mass ratio of CaO, MgO or $Al_2O_3$ to total mass % ([CaO+MgO+$Al_2O_3$] (mass %)) was obtained and shown in Table 9. Table 9 shows the results of the HAZ crack length together with the composition of the applied flux. FIG. 3 shows a relationship between the mass ratios of the inclusion composition and HAZ cracking. Each of the mass ratios is a value obtained by dividing each composition (mass %) by [CaO+MgO+$Al_2O_3$] (mass %). A solid line in FIG. 3 indicates [CaO−0.6×MgO] (mass %)/[CaO+MgO+$Al_2O_3$] (mass %)=0.2. The flux mass ratios: CaO/$Al_2O_3$, CaO/$SiO_2$, and $Al_2O_3$/MgO in Table 9 are calculated from the input amounts of CaO, $SiO_2$, $Al_2O_3$, and/or MgO. The mass % of each of MgO and $CaF_2$ is a value converted from the input amount of the corresponding one of MgO and $CaF_2$ with respect to the total flux input amount including $CaF_2$.

TABLE 9

| Steel No. | Flux Composition: Mass Ratio CaO/$Al_2O_3$ | CaO/$SiO_2$ | $Al_2O_3$/MgO | Mass % MgO | $CaF_2$ | Inclusion Composition: Mass Ratio of Composition to Total of CaO, MgO, $Al_2O_3$ CaO | MgO | $Al_2O_3$ | Left Side of Formula (1) | Total HAZ Crack Length (mm) | Remarks |
|---|---|---|---|---|---|---|---|---|---|---|---|
| A1 | 3.0 | 24.0 | 8.0 | 2.5 | 15.0 | 0.72 | 0.19 | 0.09 | 0.61 | 0.45 | Examples |
| A2 | 3.0 | 24.0 | 8.0 | 2.5 | 15.0 | 0.68 | 0.22 | 0.10 | 0.54 | 0.36 | of |
| A3 | 3.0 | 24.0 | 8.0 | 2.5 | 15.0 | 0.65 | 0.26 | 0.09 | 0.49 | 0.23 | Invention |
| A4 | 3.0 | 24.0 | 8.0 | 2.5 | 15.0 | 0.63 | 0.21 | 0.17 | 0.50 | 0.63 | |
| A5 | 1.9 | 19.0 | 11.0 | 2.5 | 15.0 | 0.72 | 0.09 | 0.19 | 0.67 | 0.48 | |
| A6 | 1.9 | 19.0 | 11.0 | 2.5 | 15.0 | 0.69 | 0.19 | 0.12 | 0.58 | 0.35 | |
| A7 | 1.5 | 18.0 | 12.0 | 2.5 | 20.0 | 0.29 | 0.07 | 0.64 | 0.25 | 0.42 | |
| A8 | 1.9 | 19.0 | 5.0 | 5.0 | 20.0 | 0.50 | 0.27 | 0.23 | 0.34 | 0.30 | |
| A9 | 1.9 | 19.0 | 5.0 | 5.0 | 20.0 | 0.48 | 0.38 | 0.14 | 0.25 | 0.89 | |
| A10 | 1.9 | 19.0 | 5.0 | 5.0 | 20.0 | 0.41 | 0.29 | 0.30 | 0.24 | 0.68 | |
| A11 | 1.4 | 14.0 | 6.0 | 5.0 | 20.0 | 0.80 | 0.16 | 0.04 | 0.71 | 0.59 | |
| A12 | 1.4 | 14.0 | 6.0 | 5.0 | 20.0 | 0.45 | 0.11 | 0.44 | 0.38 | 0.51 | |
| A13 | 1.4 | 14.0 | 6.0 | 5.0 | 20.0 | 0.54 | 0.22 | 0.24 | 0.41 | 0.93 | |
| A14 | 1.0 | 14.0 | 4.7 | 7.5 | 20.0 | 0.33 | 0.15 | 0.52 | 0.24 | 0.68 | |
| B1 | 1.5 | 11.0 | 3.7 | 7.5 | 20.0 | 0.28 | 0.23 | 0.49 | 0.14 | 2.63 | Comparatives |
| B2 | 1.5 | 11.0 | 3.7 | 7.5 | 20.0 | 0.23 | 0.40 | 0.37 | −0.01 | 3.41 | |
| B3 | 1.5 | 5.0 | 2.5 | 10.0 | 20.0 | 0.44 | 0.48 | 0.07 | 0.15 | 2.35 | |
| B4 | 1.5 | 5.0 | 2.5 | 10.0 | 20.0 | 0.42 | 0.52 | 0.06 | 0.11 | 2.05 | |
| B5 | 1.2 | 9.0 | 3.0 | 10.0 | 20.0 | 0.20 | 0.17 | 0.63 | 0.10 | 2.09 | |
| B6 | 1.5 | 16.0 | 1.6 | 17.5 | 10.0 | 0.06 | 0.88 | 0.05 | −0.47 | 2.97 | |
| B7 | 1.5 | 16.0 | 1.6 | 17.5 | 10.0 | 0.01 | 0.78 | 0.21 | −0.46 | 3.09 | |
| B8 | 1.9 | 19.0 | 5.0 | 5.0 | 20.0 | 0.27 | 0.38 | 0.35 | 0.04 | 1.63 | |
| B9 | 1.9 | 19.0 | 5.0 | 5.0 | 20.0 | 0.32 | 0.36 | 0.32 | 0.10 | 2.29 | |
| B10 | 1.9 | 19.0 | 5.0 | 5.0 | 20.0 | 0.38 | 0.41 | 0.21 | 0.13 | 3.18 | |

As shown in Table 9 and FIG. 3, in Steel Nos. A1 to A14 satisfying 0.2 or more of a value of the left side of the formula (2): [CaO−0.6×MgO] (mass %)/[CaO+MgO+$Al_2O_3$] (mass %) (denoted by white circles in FIG. 3), a value of the total HAZ crack length generated in the weld hot crack test was favorable as being 1 mm or less on average with n=2. In contrast, in Steel Nos. B1 to B10 not satisfying this relationship (denoted by black rhombi in FIG. 3), the value of the total HAZ crack length significantly exceeded 1 mm, revealing that HAZ cracking susceptibility increased sharply. Regarding Steel Nos. B1 to B4, although the components satisfied the requirements, the value of A/M was less than 4.0, so that the inclusion composition satisfying the formula (2) was not obtained. Similarly, in Steel No. B5 in which the value of NM was less than 4.0, the oxygen concentration fell out of the required range. In Steel Nos. B6 and B7, the Mg concentration fell out of the required range. In Steel Nos. B8 to B10, the value of A/M was 4 or more. However, since the Ca alloy was not added in Steel No. B8, the Ca content fell out of the range of the invention. Moreover, since Ti and Al in Steel Nos. B9 and B10 were higher than the range of the invention, Mg pick-up from the flux was thought to occur. Therefore, all of Steel Nos. B8 to B10 did not satisfy the requirements of the formula (2), exhibiting a high HAZ cracking susceptibility.

As can be seen from the above Examples, it has become clear that the third aspect of the invention can produce a high Ni alloy with a low weld hot cracking susceptibility.

INDUSTRIAL APPLICABILITY

The first aspect of the invention is cable of suitably manufacturing a welded structure using a high-Ni alloy containing Al and Ti for high-temperature applications. It is expected to improve a degree of freedom in design and reduce welding repair costs. Moreover, the high-Ni alloy can be widely used not only for high temperature applications but also for a welded structure used for high corrosion resistance applications.

A stable welding quality can be imparted to a high-Ni alloy for which demand has been expanded, thereby greatly contributing to development of industry.

The second aspect of the invention is capable of suitably manufacturing a welded structure using a high-Ni alloy containing Al and Ti for high-temperature applications. It is expected to improve the degree of freedom in design and reduce welding repair costs. Moreover, the high-Ni alloy can be widely used not only for high temperature applications but also for a welded structure used for high corrosion resistance applications.

A stable welding quality can be imparted to a high-Ni alloy for which demand has been expanded, thereby greatly contributing to development of industry.

The third aspect of the invention is capable of suitably manufacturing a welded structure using a high-Ni alloy containing Al and Ti for high-temperature applications. It is expected to improve the degree of freedom in design and reduce welding repair costs. Moreover, the high-Ni alloy can be widely used not only for high temperature applications but also for a welded structure used for high corrosion resistance applications.

A stable welding quality can be imparted to a high-Ni alloy for which demand has been expanded, thereby greatly contributing to development of industry.

The invention claimed is:

1. A high-Ni alloy having an excellent weld hot cracking resistance, comprising: in mass %, C: 0.15% or less, Si: 0.05 to 2.0%, Mn: 0.05 to 2.0%, P: 0.035% or less, S: 0.0015% or less, Cr: 16 to 30%, Ni: 18 to 50%, Al: 0.01 to 1.0%, Ti: 0.01 to 1.5%, N: 0.35% or less, O: 0.003% or less, Mo: 8% or less, Cu: 4% or less, Co: 3% or less, Ca: 0.0003 to 0.0050%, Mg: 0.0060% or less, and a balance consisting of Fe and impurities, wherein a relationship between a number density of TiC precipitates each having 1.0 μm or more of an equivalent circle diameter and a Mg content in steel satisfies a formula (1) below, $$\text{number density of TiC (number of pieces/mm}^2) \leq 463-9.5\times\text{Mg concentration in steel (mass ppm)} \quad (1).$$

2. A high-Ni alloy having an excellent weld hot cracking resistance, comprising: in mass %, C: 0.15% or less, Si: 0.05 to 2.0%, Mn: 0.05 to 2.0%, P: 0.035% or less, S: 0.0015% or less, O: 0.0020% or less, O+S in total being 0.0020% or less, Cr: 16 to 30%, Ni: 18 to 50%, Al: 0.01 to 1.0%, Ti: 0.01 to 1.5%, N: 0.02% or less, Mo: 8% or less, Cu: 4% or less, Co: 3% or less, Ca: 0.0010 to 0.0050%, Mg: 0.0010 to 0.0050%, and a balance consisting of Fe and impurities, wherein an average concentration of S in oxide inclusions and sulfide inclusions is 0.70 mass % or more.

3. A high-Ni alloy having an excellent weld hot cracking resistance, comprising: in mass %, C: 0.15% or less, Si: 0.05 to 2.0%, Mn: 0.05 to 2.0%, P: 0.035% or less, S: 0.0015% or less, Cr: 16 to 30%, Ni: 18 to 50%, Al: 0.01 to 1.0%, Ti: 0.01 to 1.5%, N: 0.35% or less, O: 0.003% or less, Mo: 8% or less, Cu: 4% or less, Co: 3% or less, Ca: 0.0003 to 0.0050%, Mg: 0.0045% or less, and a balance consisting of Fe and impurities, wherein mass ratios of CaO, MgO, and $Al_2O_3$ in inclusions, where O or S is detected, satisfy a formula (2), the mass ratios being respectively calculated from an average Ca concentration, an average Mg concentration, and an average Al concentration in the inclusions, $$[\text{CaO}-0.6\times\text{MgO}](\text{mass }\%)/[\text{CaO}+\text{MgO}+\text{Al}_2\text{O}_3](\text{mass }\%) \geq 0.20 \quad (2).$$

4. The high-Ni alloy having an excellent weld hot cracking resistance according to claim 1, further comprising: in place of a part of the Fe, in mass %, one or more of B: 0.0002 to 0.0030%, Sn: 0.05% or less, Zn+Pb+Bi: 0.0010% or less, Zr: 0.5% or less, Hf: 0.5% or less, La+Ce+Nd: 0.0050% or less, W: 3% or less, V: 0.01 to 0.5%, Nb: 0.002 to 1.0%, and Ta: 0.002 to 1.0%.

5. The high-Ni alloy having an excellent weld hot cracking resistance according to claim 1, wherein the high-Ni alloy is used in a welded structure.

6. The high-Ni alloy having an excellent weld hot cracking resistance, according to claim 4, wherein the high-Ni alloy is used in a welded structure.

7. The high-Ni alloy having an excellent weld hot cracking resistance according to claim 2, further comprising: in place of a part of the Fe, in mass %, one or more of B: 0.0002 to 0.0030%, Sn: 0.05% or less, Zn+Pb+Bi: 0.0010% or less, Zr: 0.5% or less, Hf: 0.5% or less, La+Ce+Nd: 0.0050% or less, W: 3% or less, V: 0.01 to 0.5%, Nb: 0.002 to 1.0%, and Ta: 0.002 to 1.0%.

8. The high-Ni alloy having an excellent weld hot cracking resistance according to claim 3, further comprising: in place of a part of the Fe, in mass %, one or more of B: 0.0002 to 0.0030%, Sn: 0.05% or less, Zn+Pb+Bi: 0.0010% or less, Zr: 0.5% or less, Hf: 0.5% or less, La+Ce+Nd: 0.0050% or less, W: 3% or less, V: 0.01 to 0.5%, Nb: 0.002 to 1.0%, and Ta: 0.002 to 1.0%.

9. The high-Ni alloy having an excellent weld hot cracking resistance according to claim 2, wherein the high-Ni alloy is used in a welded structure.

10. The high-Ni alloy having an excellent weld hot cracking resistance according to claim 3, wherein the high-Ni alloy is used in a welded structure.

11. The high-Ni alloy having an excellent weld hot cracking resistance, according to claim 7, wherein the high-Ni alloy is used in a welded structure.

12. The high-Ni alloy having an excellent weld hot cracking resistance, according to claim 8, wherein the high-Ni alloy is used in a welded structure.

* * * * *